US011807015B2

(12) United States Patent
Nagashima et al.

(10) Patent No.: US 11,807,015 B2
(45) Date of Patent: Nov. 7, 2023

(54) CARTRIDGE

(71) Applicant: SEIKO EPSON CORPORATION, Tokyo (JP)

(72) Inventors: Takumi Nagashima, Matsumoto (JP); Yoshihiro Koizumi, Shiojiri (JP); Shun Oya, Kiso-machi (JP); Hiroto Hanba, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 84 days.

(21) Appl. No.: 17/698,307

(22) Filed: Mar. 18, 2022

(65) Prior Publication Data

US 2022/0297437 A1 Sep. 22, 2022

(30) Foreign Application Priority Data

Mar. 19, 2021 (JP) ..... 2021-045568
Jul. 8, 2021 (JP) ..... 2021-113362

(51) Int. Cl.
*B41J 2/175* (2006.01)
*B41J 29/02* (2006.01)
*B41J 29/13* (2006.01)

(52) U.S. Cl.
CPC ..... *B41J 2/17553* (2013.01); *B41J 2/1752* (2013.01); *B41J 29/02* (2013.01); *B41J 29/13* (2013.01)

(58) Field of Classification Search
CPC ..... B41J 2/17503; B41J 2/17506; B41J 2/17509; B41J 2/17513; B41J 2/1752; B41J 2/17553; B41J 29/02; B41J 29/13
See application file for complete search history.

(56) References Cited

U.S. PATENT DOCUMENTS 3,733,915 A 5/1973 Papadatos et al.
7,950,789 B2 * 5/2011 Matsumoto ..... B41J 2/17553 347/49
8,297,738 B1 10/2012 Kodama et al.
9,079,412 B2 * 7/2015 Kanbe ..... B41J 2/17553
2008/0036828 A1 2/2008 Koike et al.
2008/0165232 A1 7/2008 Yuen
2008/0284810 A1 11/2008 Shimizu et al.
2012/0056955 A1 3/2012 Kodama et al.
2012/0200646 A1 8/2012 Karasawa et al.
2013/0208051 A1 8/2013 Koizumi
2014/0043408 A1 2/2014 Kudo et al.
2014/0253646 A1 9/2014 Koike et al.
2015/0306882 A1 10/2015 Kudo et al.
2016/0016409 A1 * 1/2016 Kimura ..... B41J 2/17513 347/86
2016/0159099 A1 6/2016 Kudo et al.
(Continued)

FOREIGN PATENT DOCUMENTS

CN 103568581 A 2/2014
EP 2727733 A1 5/2014
(Continued)

*Primary Examiner* — Anh T Vo
(74) *Attorney, Agent, or Firm* — Oliff PLC

(57) ABSTRACT

A cartridge includes a casing that demarcates a liquid chamber used for storing a liquid and that is hollow, and a liquid supply section that communicates with the liquid chamber and supplies the liquid in the liquid chamber to a printing apparatus. The casing includes a concave/convex portion.

8 Claims, 15 Drawing Sheets

(56) References Cited

U.S. PATENT DOCUMENTS

| | | | |
|---|---|---|---|
| 2017/0120613 | A1 | 5/2017 | Ikebe et al. |
| 2018/0281435 | A1 | 10/2018 | Yoshimoto et al. |

FOREIGN PATENT DOCUMENTS

| | | | |
|---|---|---|---|
| EP | 2772360 | A2 | 9/2014 |
| EP | 3231616 | A1 | 10/2017 |
| EP | 3459744 | A1 | 3/2019 |
| JP | 2007-283557 | A | 11/2007 |
| WO | 2012/086171 | A1 | 6/2012 |

* cited by examiner

CARTRIDGE

The present application is based on, and claims priority from JP Application Serial Number 2021-045568, filed Mar. 19, 2021 and JP Application Serial Number 2021-113362, filed Jul. 8, 2021, the disclosures of which are hereby incorporated by reference herein in their entirety.

BACKGROUND

1. Technical Field

The present disclosure relates to a technique of a cartridge.

2. Related Art

Cartridges including a flexible liquid storage section that stores liquid and a case that accommodates the liquid storage section have been known (for example, refer to International Publication No. WO2012/086171).

In the related art, rigidity of a case is greater than that of the liquid storage section, and the liquid storage section is protected by being accommodated in the case. When a large amount of liquid is stored in the liquid storage section, the liquid storage section supports the case from the inside. Accordingly, the liquid storage section positioned inside the case is able to suppress deformation of the case. However, when the amount of liquid stored in the liquid storage section is small, it is difficult for the liquid storage section to support the case from the inside and it may thus be difficult to suppress the deformation of the case. Accordingly, a cartridge of a type in which a liquid storage section stores a small amount of liquid may be required to include another component, such as a rib, in a case to improve rigidity of the case. A technique that is able to improve the rigidity of the case without adding another component has thus been demanded. Such a problem of the case is common to a hollow casing used for storing liquid.

SUMMARY

According to an aspect of the disclosure, a cartridge configured to be attached to and detached from a cartridge attachment section of a printing apparatus is provided. The cartridge includes a casing that demarcates a liquid chamber used for storing a liquid and that is hollow, and a liquid supply section that communicates with the liquid chamber and supplies the liquid in the liquid chamber to the printing apparatus. The casing includes a concave/convex portion.

DESCRIPTION OF EXEMPLARY EMBODIMENTS

A. Embodiment

A-1. Configuration of Printing System

Figure 1:
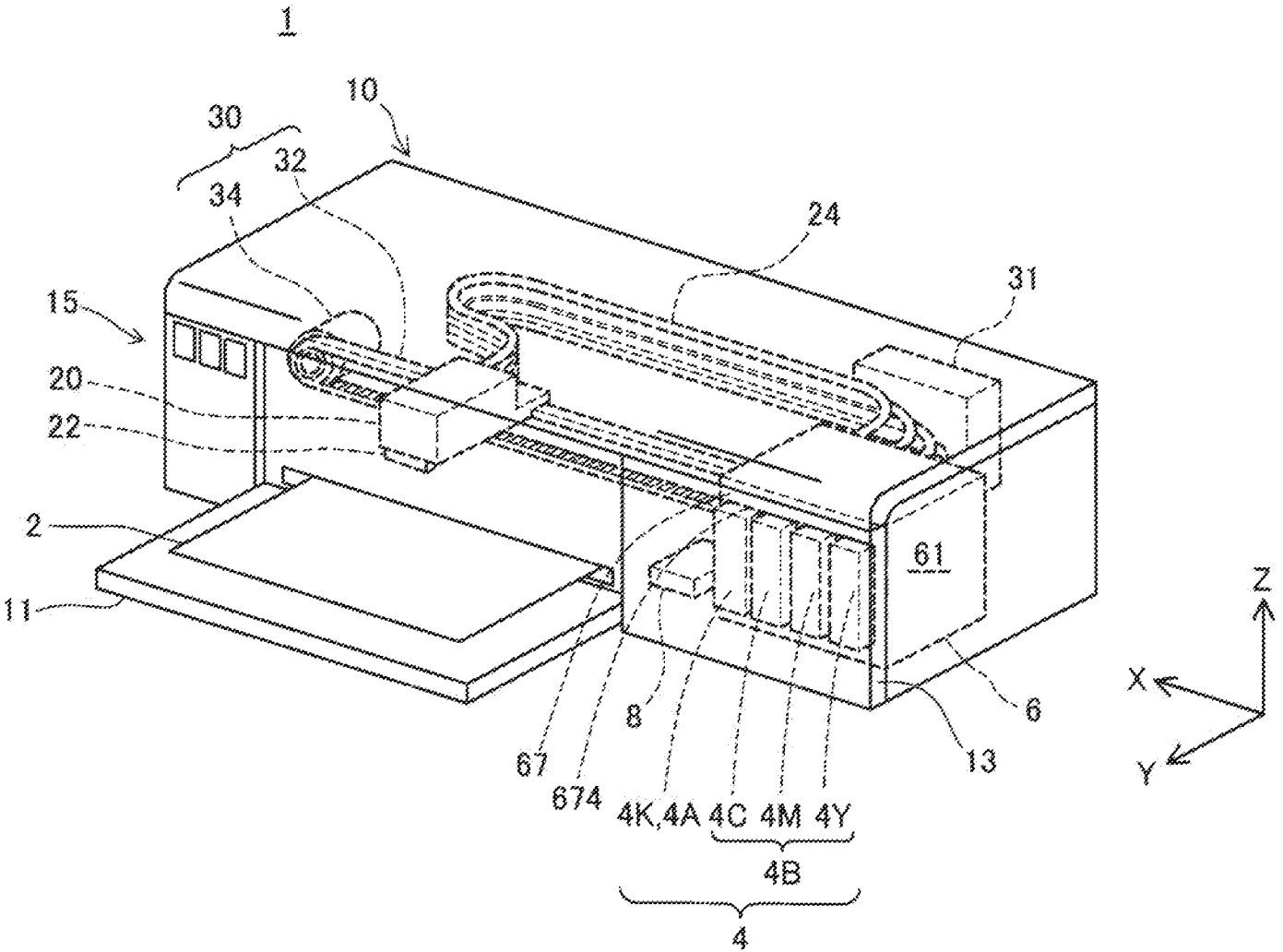
FIG. 1 is a perspective view illustrating a configuration of a printing system of an embodiment of the disclosure.

FIG. 1 is a perspective view illustrating a configuration of a printing system 1 of an embodiment of the disclosure. The XYZ axes that are three spatial axes orthogonal to each other are indicated in FIG. 1. Directions indicated by the arrows of the X-axis, the Y-axis, and the Z-axis indicate positive directions extending along the X-axis, the Y-axis, and the Z-axis, respectively. The positive directions extending along the X-axis, the Y-axis, and the Z-axis are referred to as the +X direction, the +Y direction, and the +Z direction, respectively. Directions opposite to the directions indicated by the arrows of the X-axis, the Y-axis, and the Z-axis are negative directions extending along the X-axis, the Y-axis, and the Z-axis, respectively. The negative directions extending along the X-axis, the Y-axis, and the Z-axis are referred to as the −X direction, the −Y direction, and the −Z direction, respectively. Directions that extend along the X-axis, the Y-axis, and the Z-axis regardless of whether being positive or negative are referred to as the X direction, the Y direction, and the Z direction, respectively. The same is applicable to the drawings and description below.

The printing system 1 includes a printing apparatus 10 and a cartridge 4 that supplies ink, which is an example of a liquid, to the printing apparatus 10.

The printing apparatus 10 of the present embodiment is an ink jet printer that ejects the ink, which is an example of the liquid, from an ejecting head 22. The printing apparatus 10 is a large printer that performs printing on a large sheet (for example, A0- to A2-sized sheets), such as a poster. The printing apparatus 10 includes a cartridge attachment section 6, a control section 31, a carriage 20, the ejecting head 22, and a driving mechanism 30. Moreover, the printing apparatus 10 includes operation buttons 15 used by a user to operate the printing apparatus 10.

The cartridge attachment section 6 includes a first apparatus wall 67 positioned on the +Y direction side. The first apparatus wall 67 includes an insertion/removal opening 674 through which the cartridge 4 is inserted into and removed from an accommodating chamber 61. The cartridge 4 is accommodated in or detached from the accommodating chamber 61 of the cartridge attachment section 6 via the insertion/removal opening 674. A plurality of cartridges 4 are each detachably attached to the cartridge attachment section 6. In the present embodiment, four types of the cartridges 4 which correspond to ink of four colors (black, yellow, magenta, and cyan), that is, a total of four cartridges 4, are attached to the cartridge attachment section 6. The cartridge 4 that stores black ink is referred to as a cartridge 4K, the cartridge 4 that stores yellow ink is referred to as a cartridge 4Y, the cartridge 4 that stores magenta ink is referred to as a cartridge 4M, and the cartridge 4 that stores cyan ink is referred to as a cartridge 4C. In the present embodiment, the cartridge 4K is configured to be able to store more liquid than the cartridges 4C, 4M, and 4Y. Accordingly, the cartridge 4K is also referred to as a first-type cartridge 4A, and each of the cartridges 4C, 4M, and 4Y is also referred to as a second-type cartridge 4B.

The printing apparatus 10 includes a cover for replacement 13 on the front surface on the +Y direction side. The cover for replacement 13 is configured to be openable/closable. Opening the cover for replacement 13 exposes the insertion/removal opening 674 of the cartridge attachment section 6 and enables the cartridge 4 to be attached/detached. When the cartridge 4 is attached to the cartridge attachment section 6, ink is able to be supplied to the ejecting head 22, which is provided in the carriage 20, via a tube 24 corresponding to a liquid flowing tube. In the present embodiment, the ink is supplied to the ejecting head 22 from the cartridge 4 by using a water head difference. Specifically, the water head difference between a liquid level of the ink in the cartridge attachment section 6 and the ejecting head 22 causes the ink to be supplied to the ejecting head 22. Note that, in other embodiments, the ink may be supplied to the ejecting head 22 when the ink in the cartridge 4 is sucked by a pump mechanism (not illustrated) of the printing apparatus 10. Note that the tube 24 is provided for each type of ink. Here, a state in which the cartridge 4 is attached to the cartridge attachment section 6 and in which the ink, which is an example of the liquid, is able to be supplied to the printing apparatus 10 is referred to as an "attachment completed state".

Nozzles are provided in the ejecting head 22 for each type of ink. The ejecting head 22 ejects ink from the nozzles onto a printing sheet 2 and prints data such as characters or an image. The printing apparatus 10 of the present embodiment is a printer of an off-carriage type, in which the cartridge attachment section 6 is not interlocked with movement of the carriage 20. Note that the technique of the disclosure is applicable to a printer of an on-carriage type, in which the cartridge attachment section 6 is provided in the carriage 20 and in which the cartridge attachment section 6 moves together with the carriage 20.

The control section 31 controls the respective sections of the printing apparatus 10 and transmits/receives a signal to/from the cartridge 4. The carriage 20 causes the ejecting head 22 to move relative to the printing sheet 2.

The driving mechanism 30 reciprocates the carriage 20 in accordance with a control signal from the control section 31. The driving mechanism 30 includes a timing belt 32 and a driving motor 34. Power of the driving motor 34 is transmitted to the carriage 20 via the timing belt 32, and the carriage 20 is thereby reciprocated in a main scanning direction, which is the X direction. Moreover, the printing apparatus 10 includes a transporting mechanism that moves the printing sheet 2 in a sub-scanning direction, which is the +Y direction. When printing is performed, the transporting mechanism moves the printing sheet 2 in the sub-scanning direction, and the printing sheet 2 on which printing is completed is output onto a front cover 11.

A region called a home position is provided at a position to which the carriage 20 is moved in the main scanning direction and which is outside a printing region, and a maintenance mechanism that performs maintenance to enable the printing apparatus 10 to perform printing normally is mounted at the home position. The maintenance mechanism includes, for example, a cap member 8 and a raising/lowering mechanism (not illustrated). The cap member 8 is pressed against a surface on which the nozzles are formed on the bottom surface side of the ejecting head 22 and forms a closed space so as to enclose the nozzles. The raising/lowering mechanism raises/lowers the cap member 8 so as to press the cap member 8 against the nozzle surface of the ejecting head 22.

In the present embodiment, in a use state of the printing system 1, an axis extending in the sub-scanning direction in which the printing sheet 2 is transported is the Y-axis, an axis extending in the direction of gravity (downward direction) is the Z-axis, and an axis extending in a direction in which the carriage 20 moves is the X-axis. Here, "use state of the printing system 1" denotes a state in which the printing system 1 is installed on a horizontal surface. Moreover, in the present embodiment, the sub-scanning direction is the +Y direction, a direction opposite thereto is the −Y direction, a downward direction in the direction of gravity is the −Z direction, and an upward direction opposite to the direction of gravity is the +Z direction. The X direction and the Y direction extend in the horizontal direction. When the printing system 1 is viewed from the front surface side, a direction from the right to the left is the +X direction, and a direction opposite thereto is the −X direction. Further, in the present embodiment, an inserting direction D1 in which the cartridge 4 is inserted into the cartridge attachment section 6 for attachment is the −Y direction, and a detaching direction D4 in which the cartridge 4 is detached from the cartridge attachment section 6 is the +Y direction. Accordingly, in the cartridge attachment section 6, the −Y direction side is also referred to as a back side, and the +Y direction side is also referred to as a front side. In the present embodiment, an arrangement direction of the plurality of cartridges 4 extends in the X direction.

Figure 2:
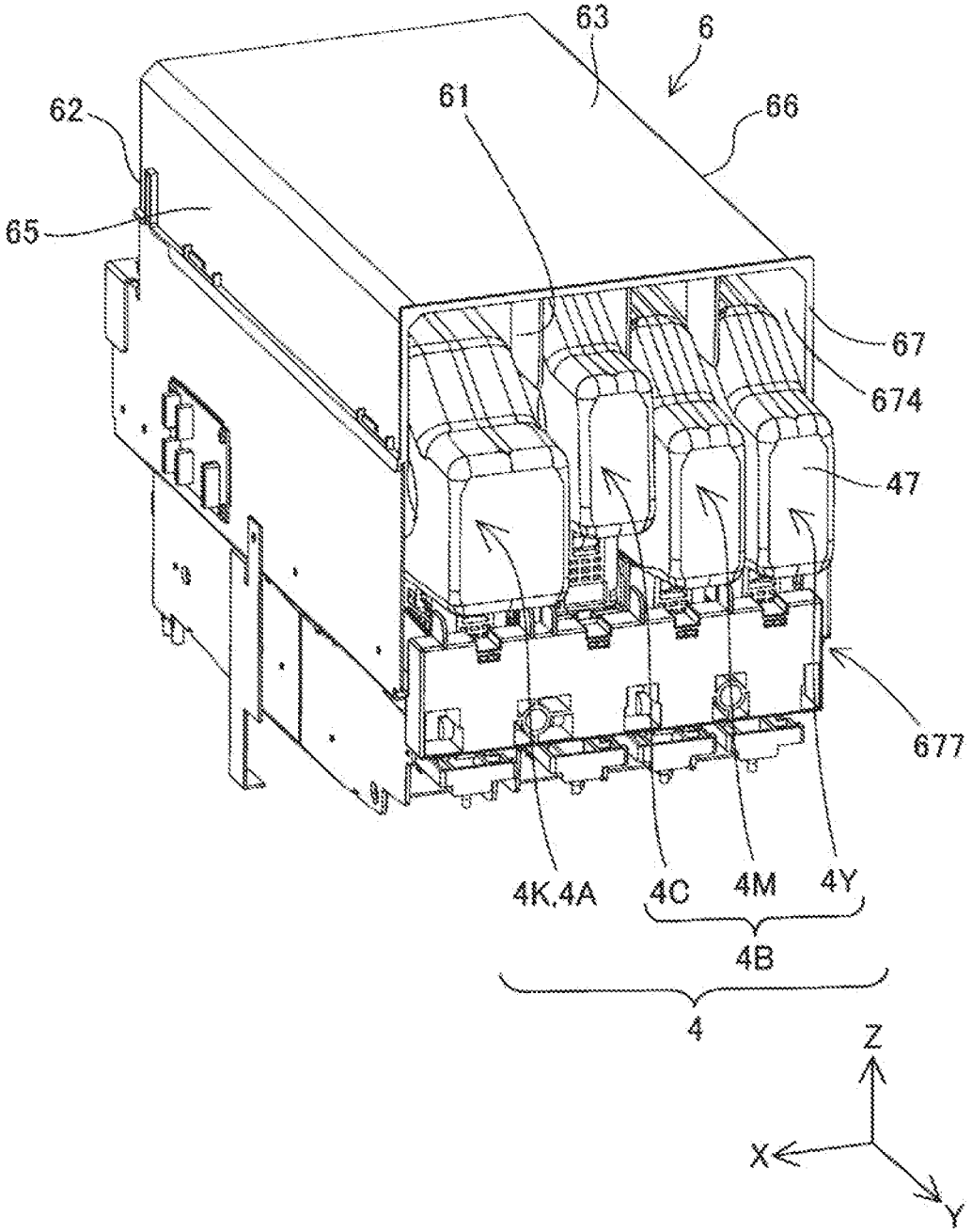
FIG. 2 illustrates a cartridge attachment section and a cartridge.

FIG. 2 is a view for describing the cartridge attachment section 6 and the cartridge 4. FIG. 2 illustrates the attachment completed state in which attachment of the cartridges 4K, 4M, and 4Y to the cartridge attachment section 6 is completed. Moreover, FIG. 2 illustrates an insertion completed state in which insertion of the cartridge 4C into the cartridge attachment section 6 is completed. In the attachment completed state, the rear wall 47 side of the cartridge 4 is located on a lower side in the direction of gravity compared with the insertion completed state.

A-2. Description of Attaching Process and Attached State of Cartridge

Figure 3:
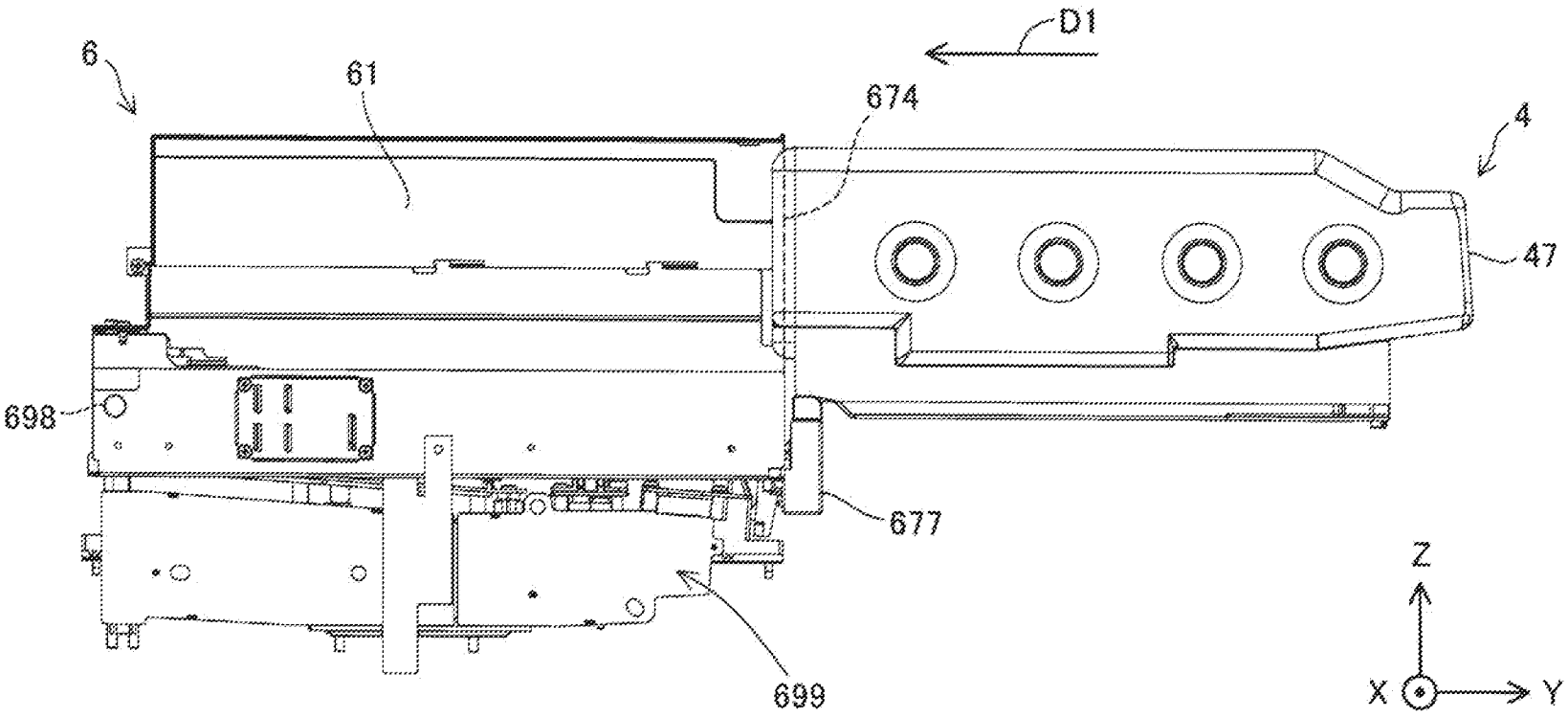
FIG. 3 is a first view for describing a process of attaching the cartridge to the cartridge attachment section.
Figure 4:
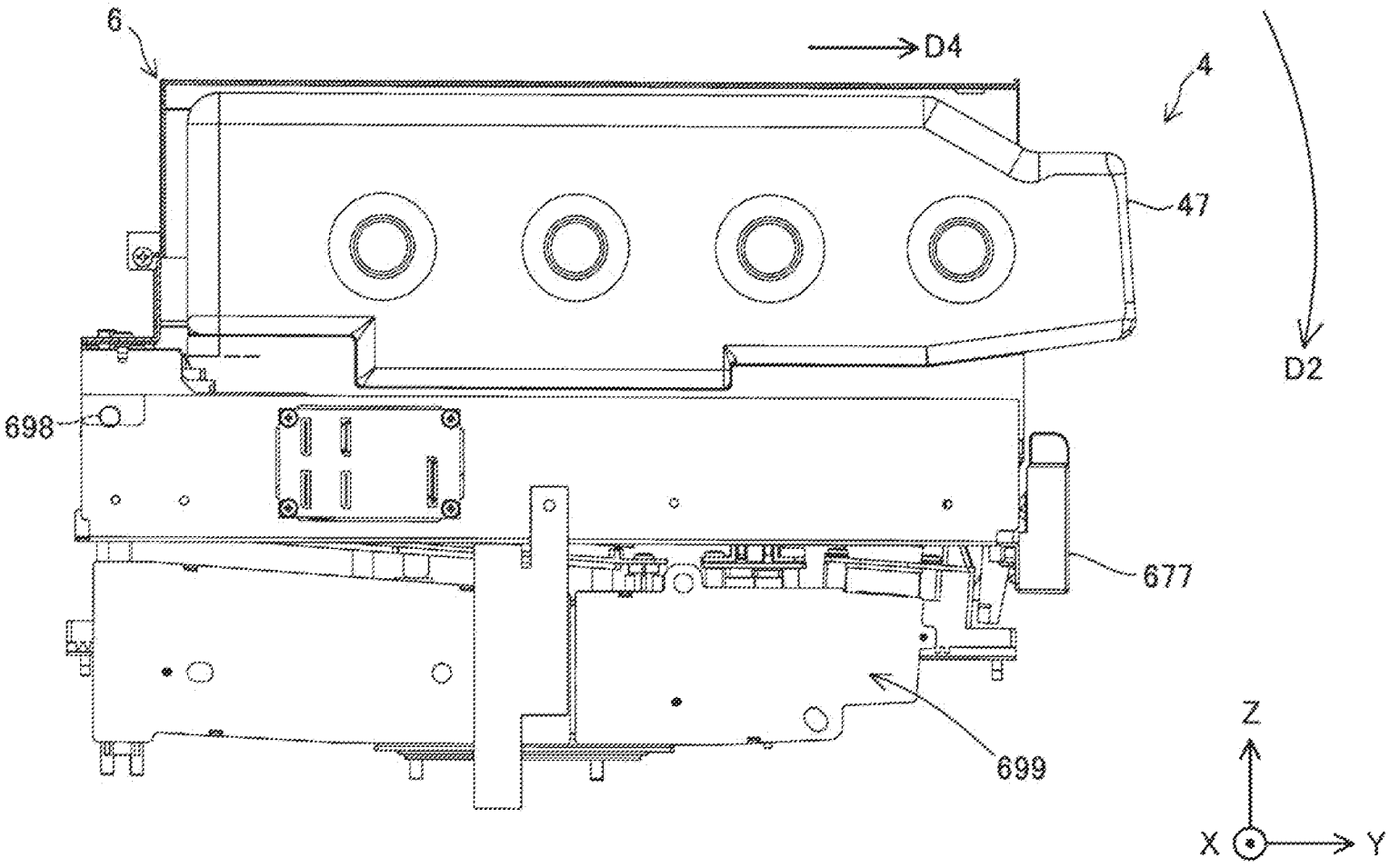
FIG. 4 is a second view for describing the process of attaching the cartridge.
Figure 5:
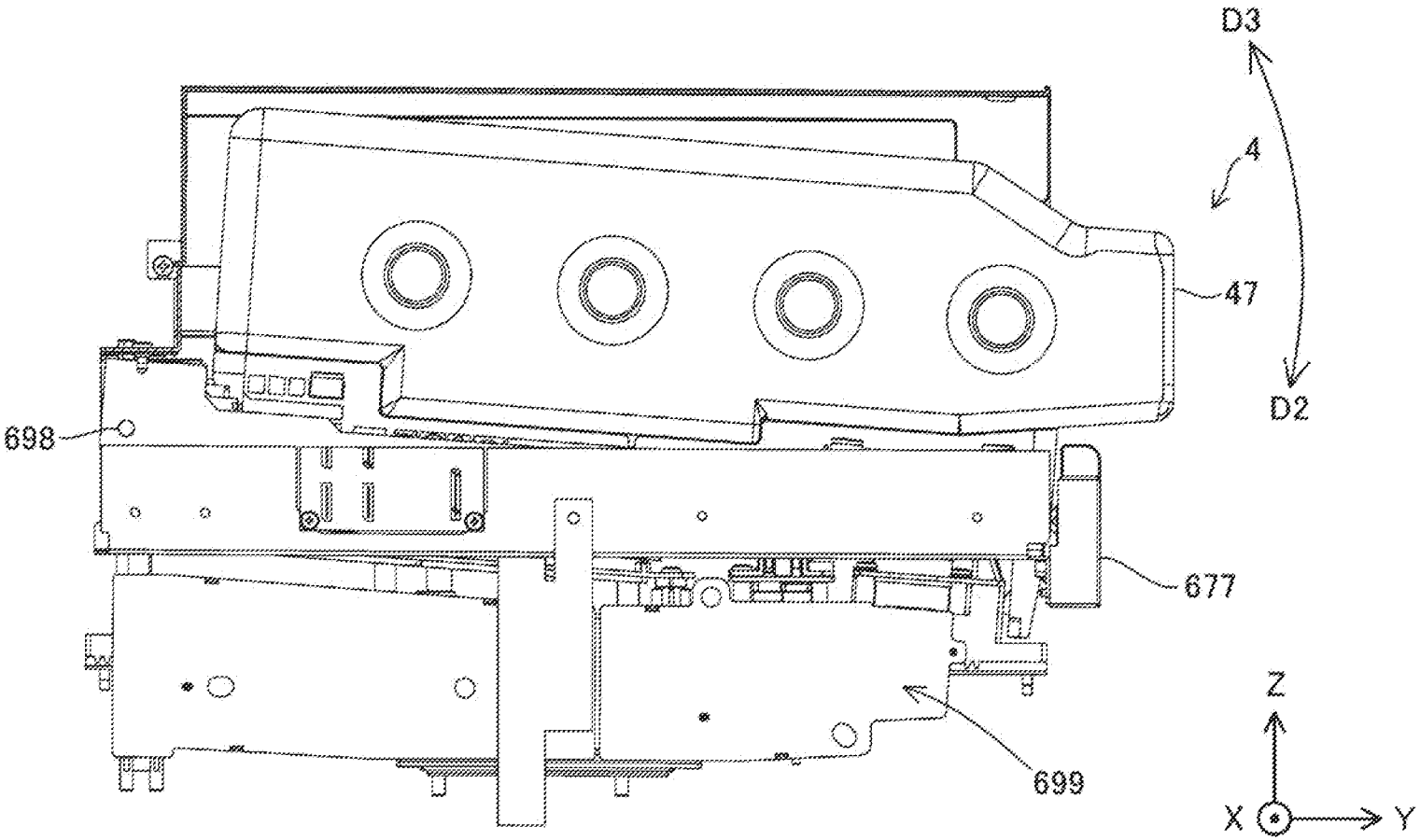
FIG. 5 illustrates an attachment completed state of the cartridge.
Figure 6:
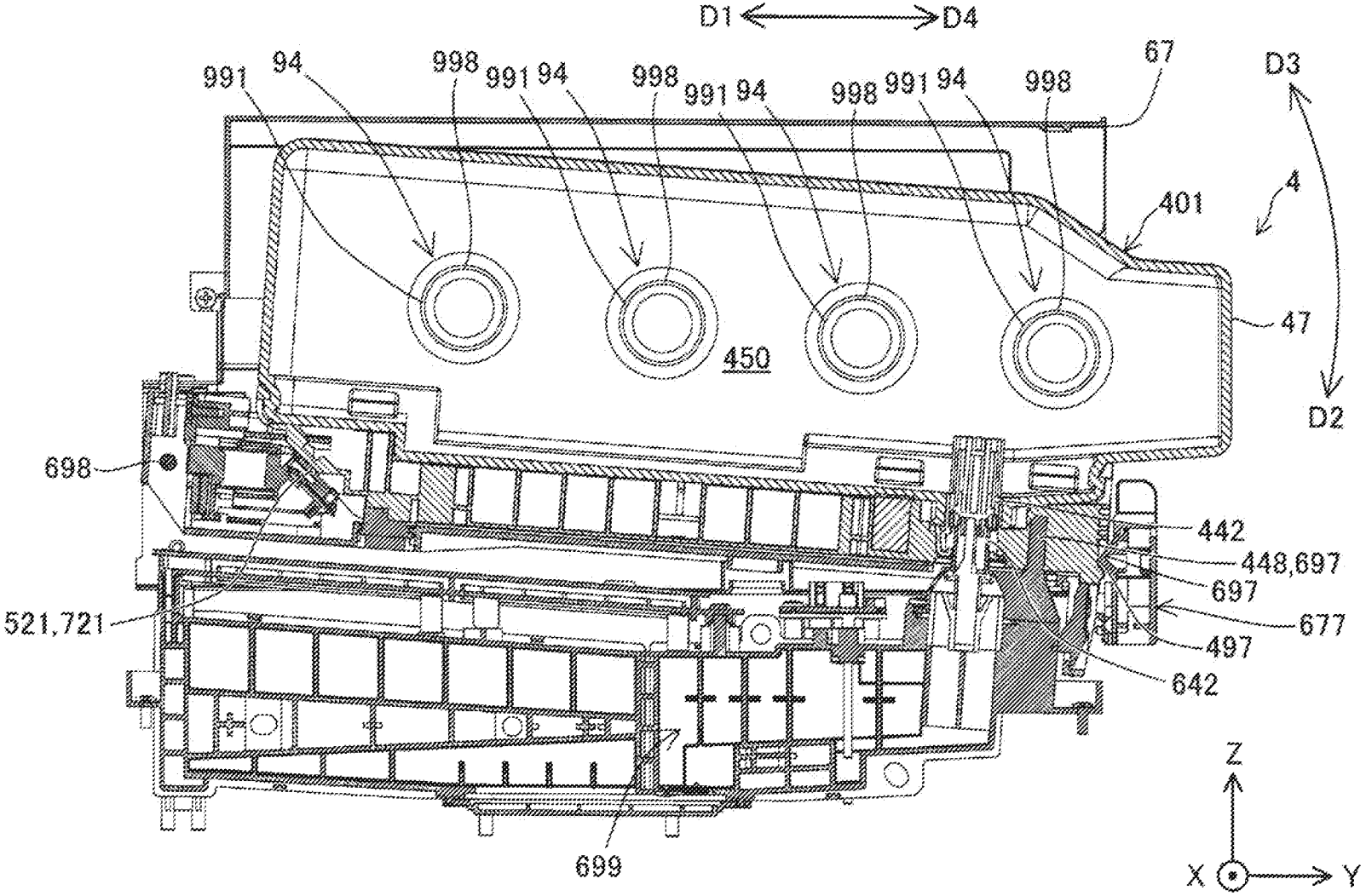
FIG. 6 is a sectional view of the cartridge and the cartridge attachment section in the attachment completed state.

FIG. 3 is a first view for describing a process of attaching the cartridge 4 to the cartridge attachment section 6. FIG. 4 is a second view for describing the attaching process. FIG. 5 illustrates the attachment completed state in which attachment of the cartridge 4 to the cartridge attachment section 6 is completed. FIG. 6 is a sectional view of the cartridge 4 and the cartridge attachment section 6 in the attachment completed state.

The process of attaching the cartridge 4 to the cartridge attachment section 6 includes a terminal coupling process and a supply section coupling process performed next after the terminal coupling process. The terminal coupling process is a process in which the cartridge 4 is moved in the inserting direction D1, which is the −Y direction, to be inserted into the accommodating chamber 61 of the cartridge attachment section 6 via the insertion/removal opening 674 of the first apparatus wall 67 such that an apparatus-side terminal of the cartridge attachment section 6, which will be described later, and a cartridge-side terminal of the cartridge 4, which will be described later, are brought into contact with each other and electrically coupled, as illustrated in FIG. 3. The supply section coupling process is a process in which a liquid introducing section of the cartridge attachment section 6, which will be described later, and a liquid supply section of the cartridge 4, which will be described later, are coupled in a state in which the apparatus-side terminal and the cartridge-side terminal are kept electrically coupled, as illustrated in FIGS. 4 and 5. Specifically, in the supply section coupling process, when the rear wall 47 side of the cartridge 4 is rotationally moved in a coupling direction D2, which is indicated by an arrow, about a rotation fulcrum 698 of the cartridge attachment section 6, the liquid introducing section and the liquid supply section are coupled. Note that, in the attachment completed state illustrated in FIG. 5, an engagement forming body 677 provided on the first apparatus wall 67 side of the cartridge attachment section 6 engages the cartridge 4, and the cartridge 4 thereby retains the attachment completed state.

When the cartridge 4 is detached from the cartridge attachment section 6, as illustrated in FIG. 5, a user raises the rear wall 47 side of the cartridge 4 to thereby rotationally move the rear wall 47 side in a coupling terminating direction D3, which is opposite to the coupling direction D2, with the rotation fulcrum 698 as a fulcrum. The rotational movement terminates the engagement performed by the engagement forming body 677. When moved in the +Y direction, which is the detaching direction D4, after rotationally moved in the coupling terminating direction D3 and brought into the state illustrated in FIG. 4, the cartridge 4 is detached from the cartridge attachment section 6.

In the attachment completed state of the cartridge 4, a liquid supply section 442 of the cartridge 4 and a liquid introducing section 642 of the cartridge attachment section 6 are coupled as illustrated in FIG. 6. Accordingly, the liquid stored in a liquid chamber 450 of the cartridge 4 is supplied to the liquid introducing section 642 via the liquid supply section 442. Moreover, in the present embodiment, whereas the liquid is supplied from the liquid supply section 442 to the liquid introducing section 642, air that accumulates in a liquid accumulation section 699 of the cartridge attachment section 6 forms air bubbles, and the air bubbles flow to the liquid chamber 450 by flowing through the liquid introducing section 642 and the liquid supply section 442. Gas-liquid exchange in the liquid chamber 450 is thus performed. Note that, in other embodiments, the cartridge 4 may include an air communication path that enables the liquid chamber 450 to communicate with the outside, and gas-liquid exchange may be performed via the air communication path. The air communication path is arranged at a position different from that of the liquid supply section 442 and is formed in, for example, a casing 401 that forms the liquid chamber 450.

Moreover, in the attachment completed state of the cartridge 4, a cartridge engagement section 497 of the cartridge 4 engages an attachment engagement section 697 of the cartridge attachment section 6, and the attachment completed state is thereby retained. The attachment engagement section 697 is formed in the engagement forming body 677 positioned on the first apparatus wall 67 side of the cartridge attachment section 6.

A-3. Details of Configuration of Cartridge Attachment Section 6

Figure 7:
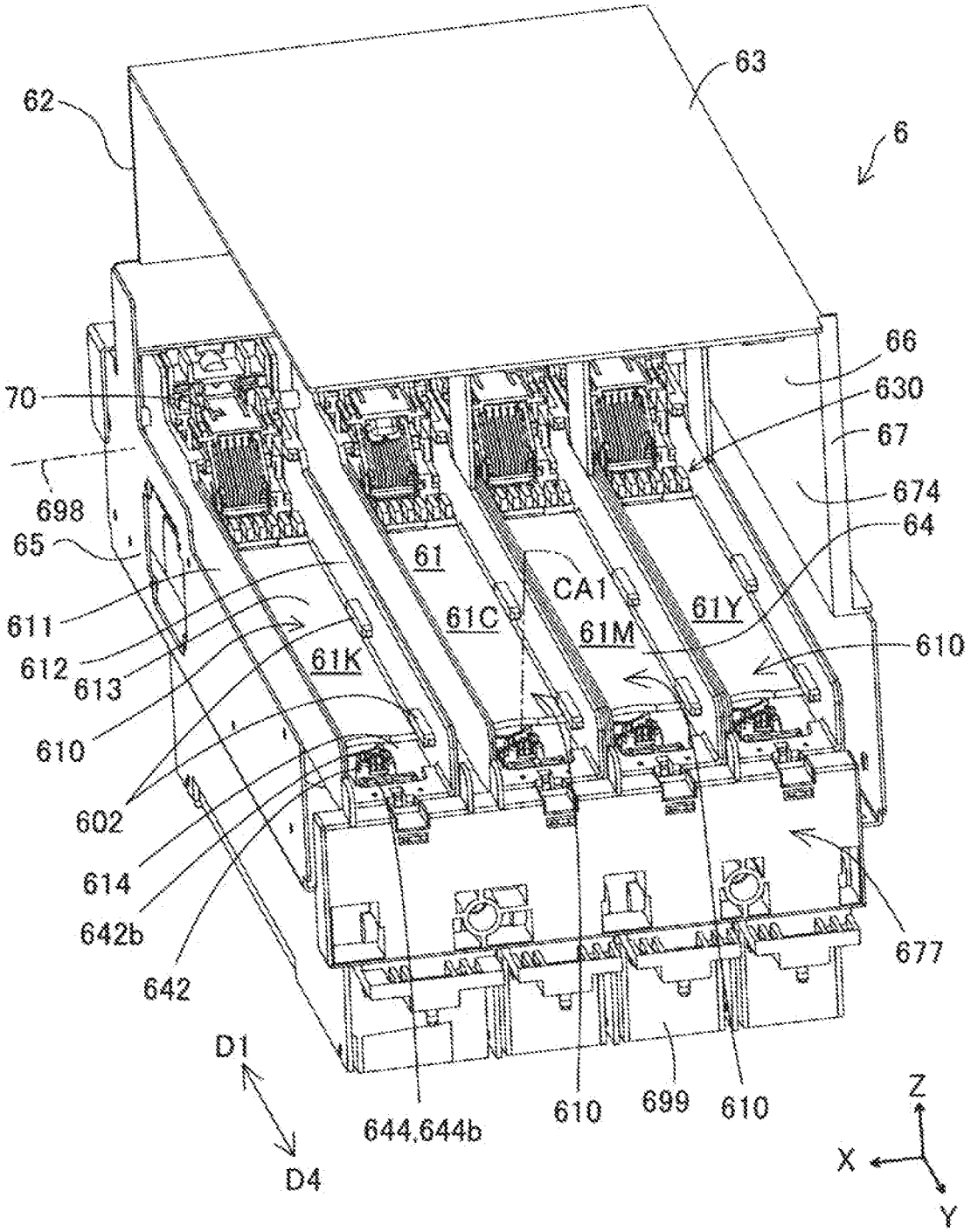
FIG. 7 is a perspective view of the cartridge attachment section.
Figure 8:
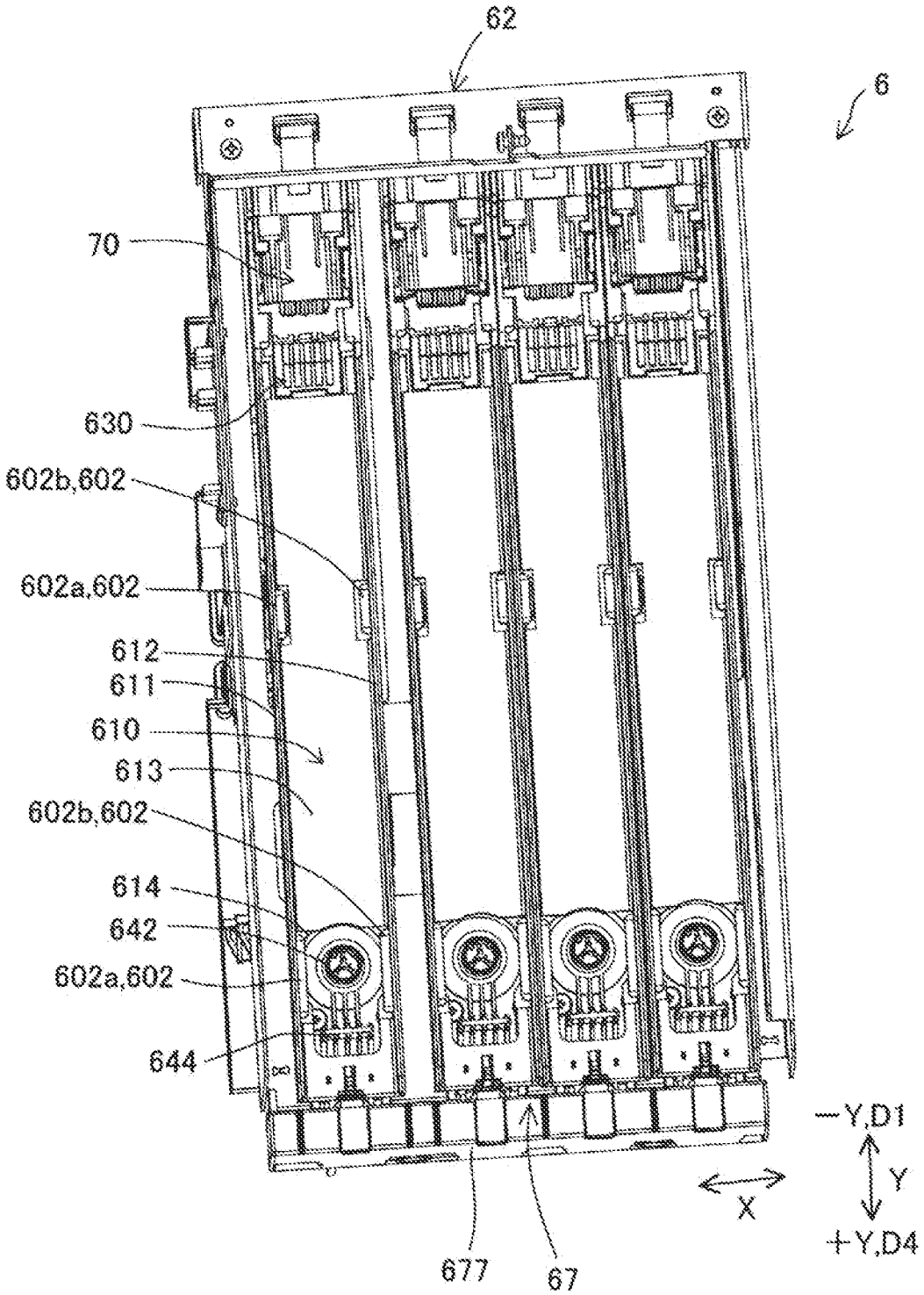
FIG. 8 illustrates the cartridge attachment section viewed from the +Z direction side.

FIG. 7 is a perspective view of the cartridge attachment section 6. FIG. 8 illustrates the cartridge attachment section 6 viewed from the +Z direction side. In FIGS. 7 and 8, for ease of understanding, illustration of the configuration of the cartridge attachment section 6 is partially omitted. Regarding the cartridge attachment section 6, the X direction, the Y direction, and the Z direction are also referred to as a width direction, a depth direction, and a height direction, respectively. In the following description, regarding the state, unless otherwise stated, each component will be described on the assumption that the cartridge attachment section 6 is in an initial arrangement state in which the cartridge 4 is not attached to the cartridge attachment section 6.

As illustrated in FIG. 7, the cartridge attachment section 6 forms the accommodating chamber 61 that accommodates the cartridge 4. The accommodating chamber 61 has an approximately rectangular parallelepiped shape. In the accommodating chamber 61, shapes of slots 61C, 61M, 61Y, and 61K, which are portions for accommodating the cartridges 4C, 4M, 4Y, and 4K, respectively, substantially correspond to outer shapes of the cartridges 4C, 4M, 4Y, and 4K, respectively. In the present embodiment, the dimension of the cartridge 4K in the X direction is larger than that of each of the other cartridges 4C, 4M, and 4Y such that the amount of liquid to be stored in the cartridge 4K is increased. Accordingly, the width of the slot 61K is greater than that of each of the other slots 61C, 61M, and 61Y in the present embodiment.

As illustrated in FIG. 7, the cartridge attachment section 6 includes six apparatus walls 62, 63, 64, 65, 66, and 67 that form the accommodating chamber 61. In the disclosure, "wall" conceptually includes a wall constituted by a plurality of walls in addition to a wall constituted by a single wall. The first apparatus wall 67 forms the insertion/removal opening 674 through which the cartridge 4 is inserted into or detached from the accommodating chamber 61. The second apparatus wall 62 forms a wall of the accommodating chamber 61 on the −Y direction side. The second apparatus wall 62 faces the first apparatus wall 67 in the Y direction. The second apparatus wall 62 is substantially vertical in a use state of the printing apparatus 10.

The apparatus top wall 63 forms a wall of the accommodating chamber 61 on the +Z direction side. The apparatus bottom wall 64 faces the apparatus top wall 63 in the Z direction and forms a wall of the accommodating chamber 61 on the −Z direction side. The apparatus bottom wall 64 is formed of a supporting member 610. The apparatus bottom wall 64 includes a plurality of apparatus openings 614. In the present embodiment, four apparatus openings 614 are formed so as to correspond to the slots 61C, 61M, 61Y, and 61K. The apparatus top wall 63 and the apparatus bottom wall 64 intersect the second apparatus wall 62 and the first apparatus wall 67. In the disclosure, "intersect" denotes any of the following states: (i) a state in which two components intersect each other and actually cross each other; (ii) a state in which, when one of two components is extended, the one component crosses the other component; and (iii) a state in which, when two components are extended, the two components cross each other.

The first apparatus side wall 65 forms a wall of the accommodating chamber 61 on the +X direction side. The second apparatus side wall 66 faces the first apparatus side wall 65 in the X direction and forms a wall of the accommodating chamber 61 on the −X direction side. The first apparatus side wall 65 and the second apparatus side wall 66 intersect the second apparatus wall 62, the first apparatus wall 67, the apparatus top wall 63, and the apparatus bottom wall 64.

As illustrated in FIGS. 7 and 8, the cartridge attachment section 6 further includes the supporting member 610, the liquid introducing section 642, a supply section positioning section 644, an apparatus guiding section 602, and the engagement forming body 677. A plurality of supporting members 610 are provided so as to correspond to the number of cartridges 4 to be attached. In the present embodiment, four supporting members 610 are provided. The supporting member 610 forms the apparatus bottom wall 64 of the accommodating chamber 61 on the lower side in the direction of gravity (downward direction). The supporting member 610 supports the cartridge 4 from the −Z direction side, which is the lower side in the direction of gravity. The supporting member 610 extends in the Y direction and has a recessed shape. The supporting member 610 includes a main wall 613 forming the apparatus bottom wall 64, a first supporting side wall 611, and a second supporting side wall 612.

The main wall 613 forms a recessed bottom portion positioned on the lower side in the direction of gravity. The apparatus opening 614 is formed in the end of the main wall 613 on the first apparatus wall 67 side. The apparatus opening 614 passes through the main wall 613 in the thickness direction of the main wall 613.

As illustrated in FIG. 7, the first supporting side wall 611 stands in the +Z direction, which is the upward direction opposite to the direction of gravity, from the end of the main wall 613 on the +X direction side. The second supporting side wall 612 stands in the +Z direction from the end of the main wall 613 on the −X direction side. The first supporting side wall 611 and the second supporting side wall 612 face each other in the X direction.

The apparatus guiding section 602 guides the cartridge 4 in the inserting direction D1 or the detaching direction D4. The apparatus guiding section 602 is provided for each of the supporting members 610. The apparatus guiding section 602 is provided in each of the first supporting side wall 611 and the second supporting side wall 612. The apparatus guiding section 602 is a protrusion provided in each of the first supporting side wall 611 and the second supporting side wall 612. As illustrated in FIG. 8, a first apparatus guiding section 602*a* provided in the first supporting side wall 611 is a protrusion protruding from the first supporting side wall 611 toward the second supporting side wall 612. The first apparatus guiding section 602*a* extends in the Y direction. A plurality of first apparatus guiding sections 602*a* are arranged with a gap therebetween in the Y direction. A second apparatus guiding section 602*b* provided in the second supporting side wall 612 is a protrusion protruding from the second supporting side wall 612 toward the first supporting side wall 611. The second apparatus guiding section 602*b* extends in the Y direction. A plurality of second apparatus guiding sections 602*b* are arranged with a gap therebetween in the Y direction.

As illustrated in FIGS. 7 and 8, the liquid introducing section 642 receives the liquid of the cartridge 4. In the initial arrangement state of the cartridge attachment section 6, the liquid introducing section 642 is positioned not in the accommodating chamber 61 but on the −Z direction side with respect to the accommodating chamber 61. That is, the liquid introducing section 642 is positioned opposite the supporting member 610 with the accommodating chamber 61 therebetween. Accordingly, when the cartridge 4 is inserted into the accommodating chamber 61 of the cartridge attachment section 6, it is possible to prevent the cartridge 4 from coming into collision with the liquid introducing section 642. When the supporting member 610 is rotationally moved in the coupling direction D2 about the rotation fulcrum 698 to push the apparatus opening 614 down, a tip end 642*b* of the liquid introducing section 642 is arranged in the accommodating chamber 61. That is, the supporting member 610 is rotationally moved about the rotation fulcrum 698 to thereby move the apparatus opening 614 to the lower side in the direction of gravity such that the tip end 642*b* of the liquid introducing section 642 is arranged in the accommodating chamber 61 through the apparatus opening 614.

When received by a supply section positioning section 448, an apparatus-side supply section positioning section 644 illustrated in FIG. 7 regulates movement of the liquid supply section 442 with respect to the liquid introducing section 642. The liquid supply section 442 is thus positioned. In the initial arrangement state of the cartridge attachment section 6, the apparatus-side supply section positioning section 644 is positioned not in the accommodating chamber 61 but on the −Z direction side with respect to the accommodating chamber 61. That is, the apparatus-side supply section positioning section 644 is positioned opposite the supporting member 610 with the accommodating chamber 61 therebetween. Accordingly, when the cartridge 4 is inserted into the accommodating chamber 61 of the cartridge attachment section 6, it is possible to prevent the cartridge 4 from coming into collision with the apparatus-side supply section positioning section 644. When the supporting member 610 is rotated in the coupling direction D2 about the rotation fulcrum 698 to push the apparatus opening 614 down, the other end 644*b* of the apparatus-side supply section positioning section 644 is arranged in the accommodating chamber 61. That is, the supporting member 610 is rotated about the rotation fulcrum 698 to thereby move the apparatus opening 614 such that the other end 644*b* of the apparatus-side supply section positioning section 644 is arranged in the accommodating chamber 61 through the apparatus opening 614.

As illustrated in FIG. 8, the cartridge attachment section 6 further includes an apparatus-side terminal section 70 and an apparatus-side identifying member 630. The apparatus-side identifying member 630 is used for identifying whether or not a correct type of the cartridge 4C, 4M, 4Y, or 4K is inserted into a corresponding one of the slots 61C, 61M, 61Y, and 61K of the accommodating chamber 61. A pattern shape of the apparatus-side identifying member 630 differs in accordance with the color of the liquid stored in each of the cartridges 4C, 4M, 4Y, and 4K. FIG. 7 illustrates apparatus-side identifying members 630 with the same pattern shape between the slots 61C, 61M, 61Y, and 61K for convenience, but such pattern shapes differ in the actual apparatus-side identifying members 630. The apparatus-side identifying member 630 is provided in the main wall 613 of the supporting member 610.

The apparatus-side identifying member 630 is formed of at least a single rib. The pattern shape is determined in accordance with the number of ribs and positions of the ribs. A cartridge-side identifying member formed of a rib is provided in the cartridge 4. A pattern shape of the cartridge-side identifying member differs in accordance with the type of the cartridge 4, that is, the color of the stored liquid. When the correct type of the cartridge 4 is inserted into the corresponding one of the slots 61C, 61M, 61Y, and 61K, the apparatus-side identifying member 630 and the cartridge-side identifying member do not come into collision with each other. On the other hand, when an incorrect type of the cartridge 4 is inserted into the slot 61C, 61M, 61Y, or 61K, the apparatus-side identifying member 630 and the cartridge-side identifying member come into collision with each other, and the cartridge 4 is hindered from being further inserted. This reduces the possibility of attaching an incorrect type of the cartridge 4 to the slot 61C, 61M, 61Y, or 61K of the cartridge attachment section 6.

As illustrated in FIG. 7, the engagement forming body 677 is formed on the +Y direction side with respect to the supporting member 610. Moreover, the engagement forming body 677 is positioned on the −Z direction side with respect to the insertion/removal opening 674. Four attachment engagement sections 697 illustrated in FIG. 6 and corresponding to the slots 61C, 61M, 61Y, and 61K are arranged in the engagement forming body 677.

A-4. Details of Configuration of Cartridge 4

Figure 9:
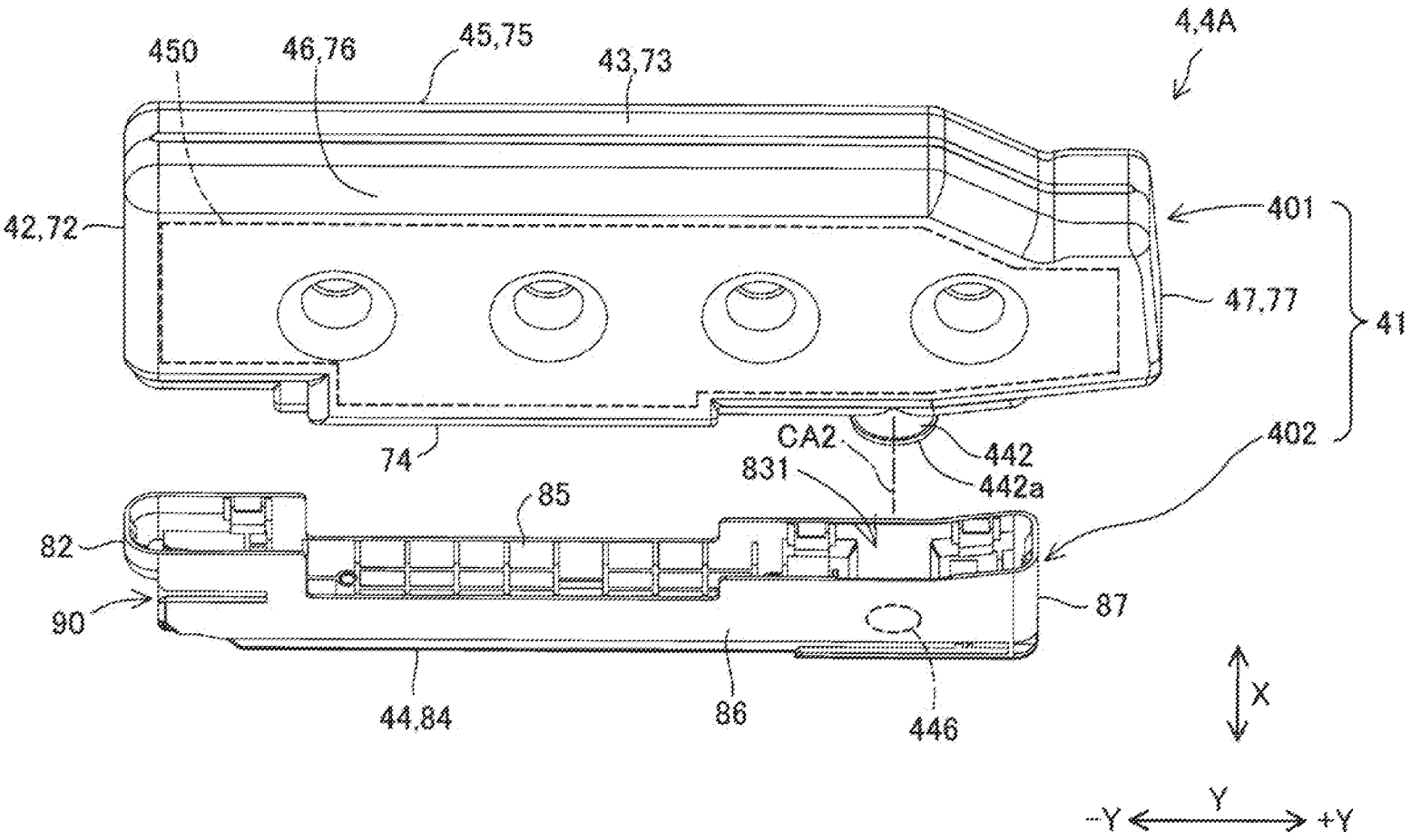
FIG. 9 is an exploded perspective view of a first-type cartridge.
Figure 10:
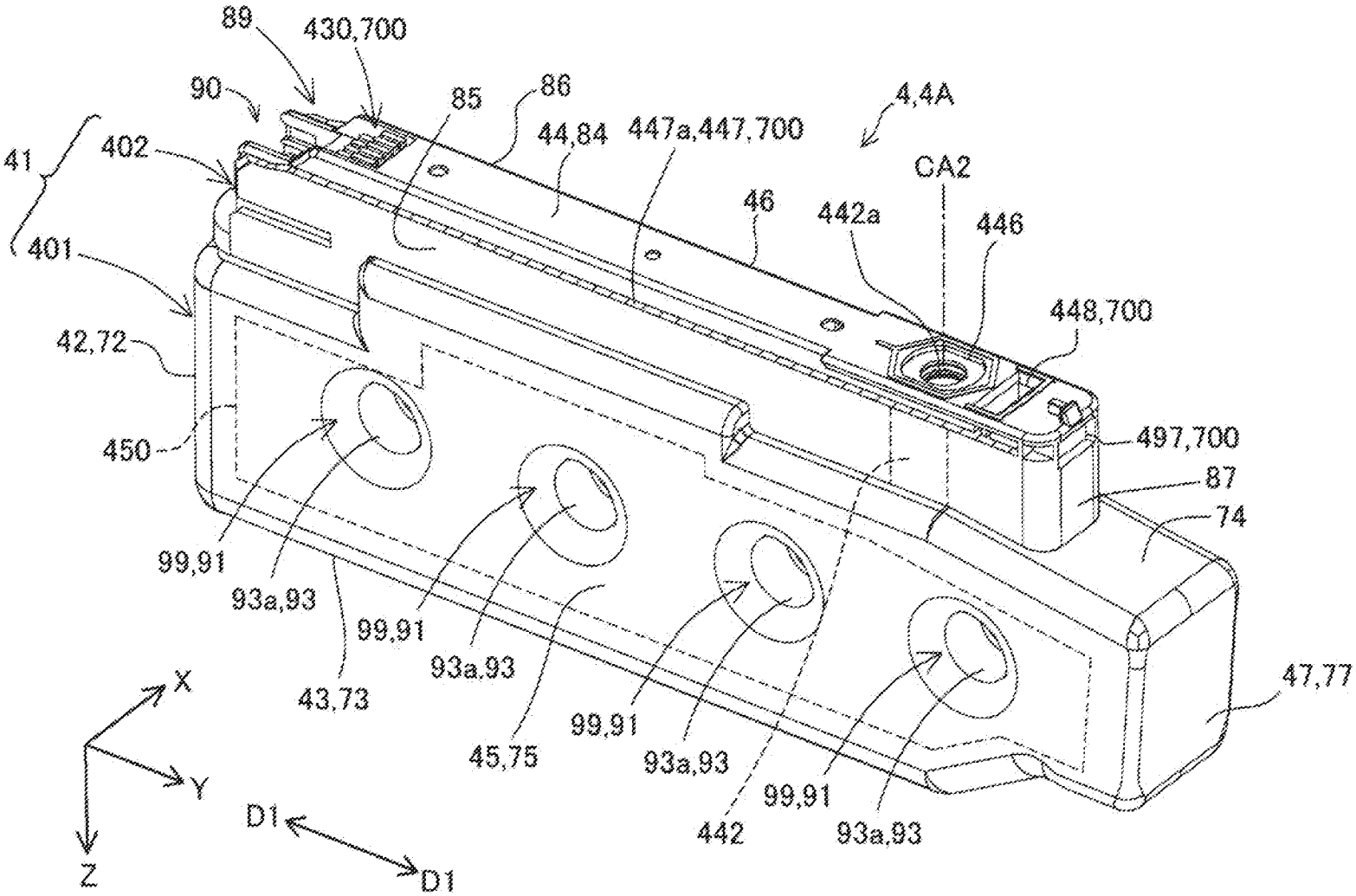
FIG. 10 is a first perspective view of the first-type cartridge.
Figure 11:
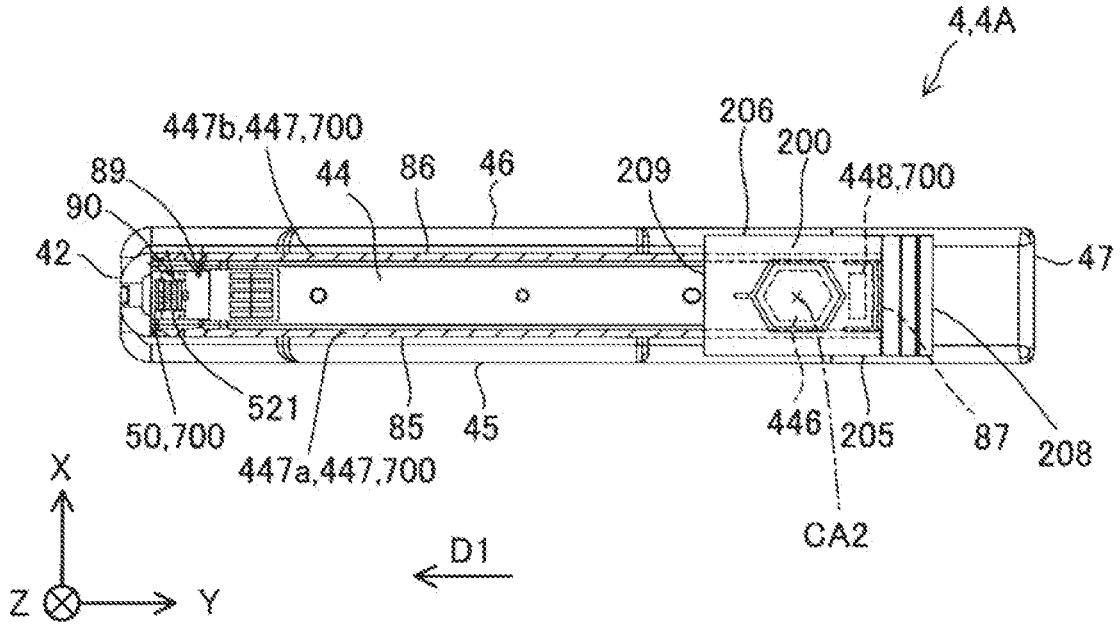
FIG. 11 is a bottom view of the first-type cartridge.
Figure 12:
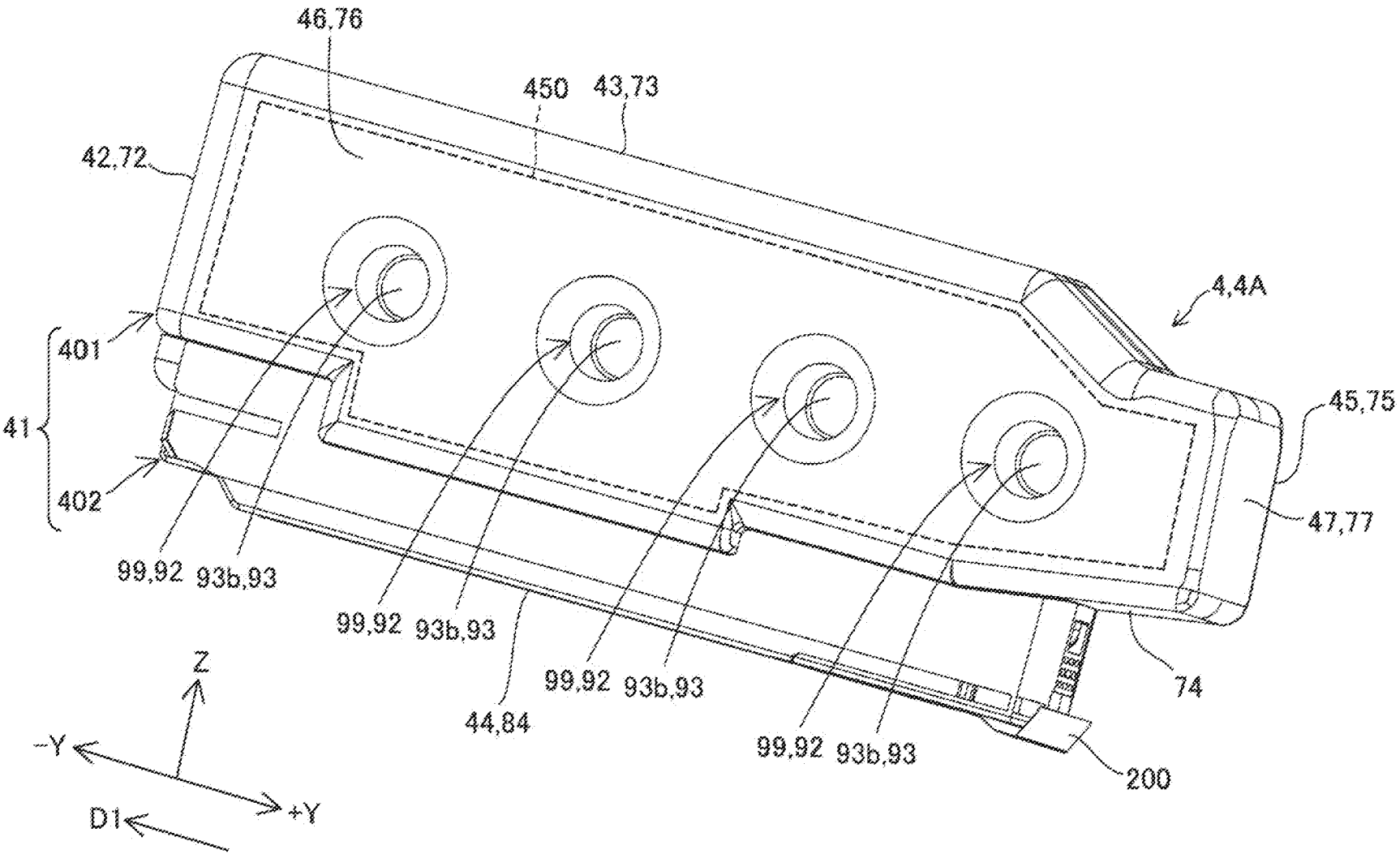
FIG. 12 is a second perspective view of the first-type cartridge.
Figure 13:
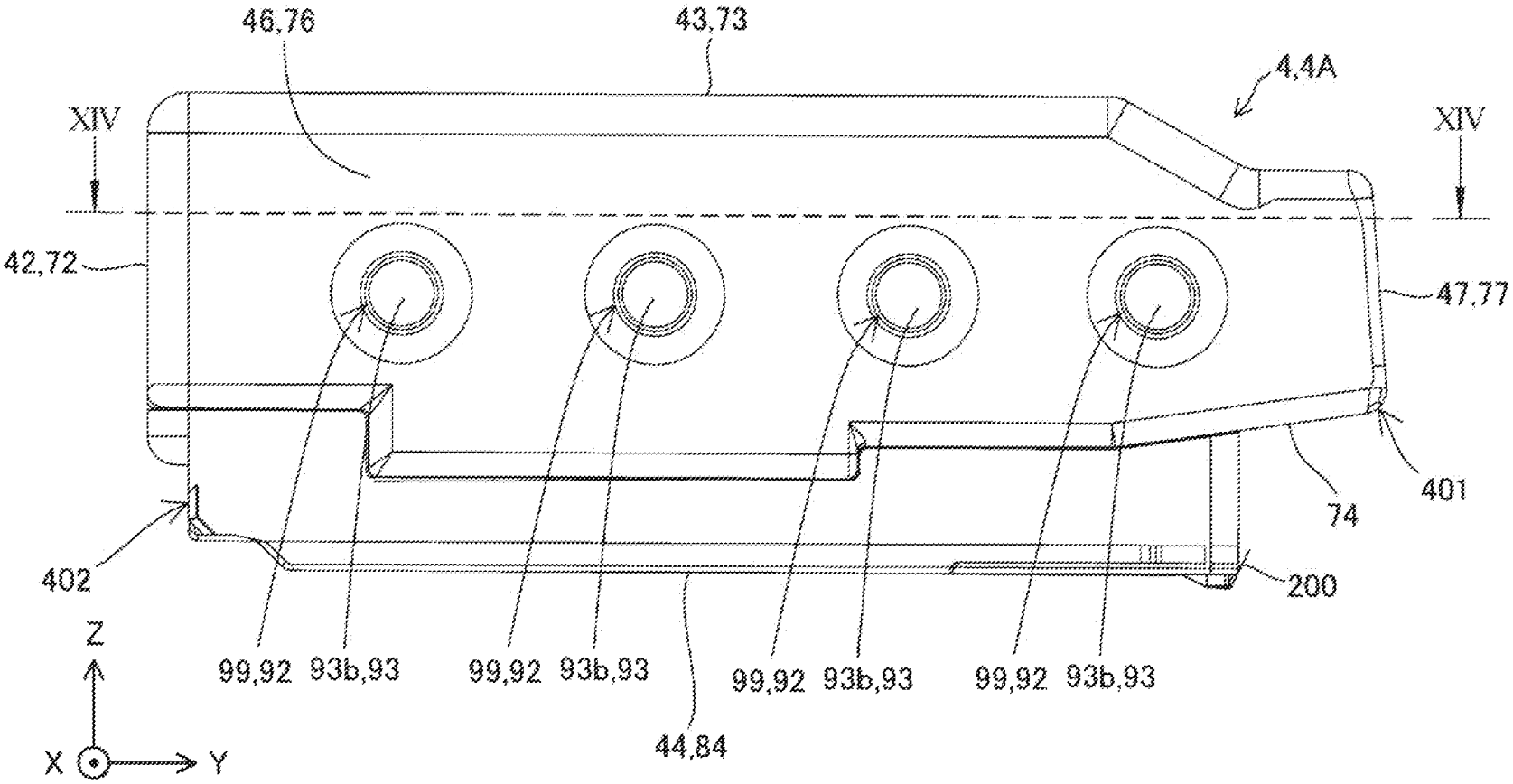
FIG. 13 is a side view of the first-type cartridge.
Figure 14:
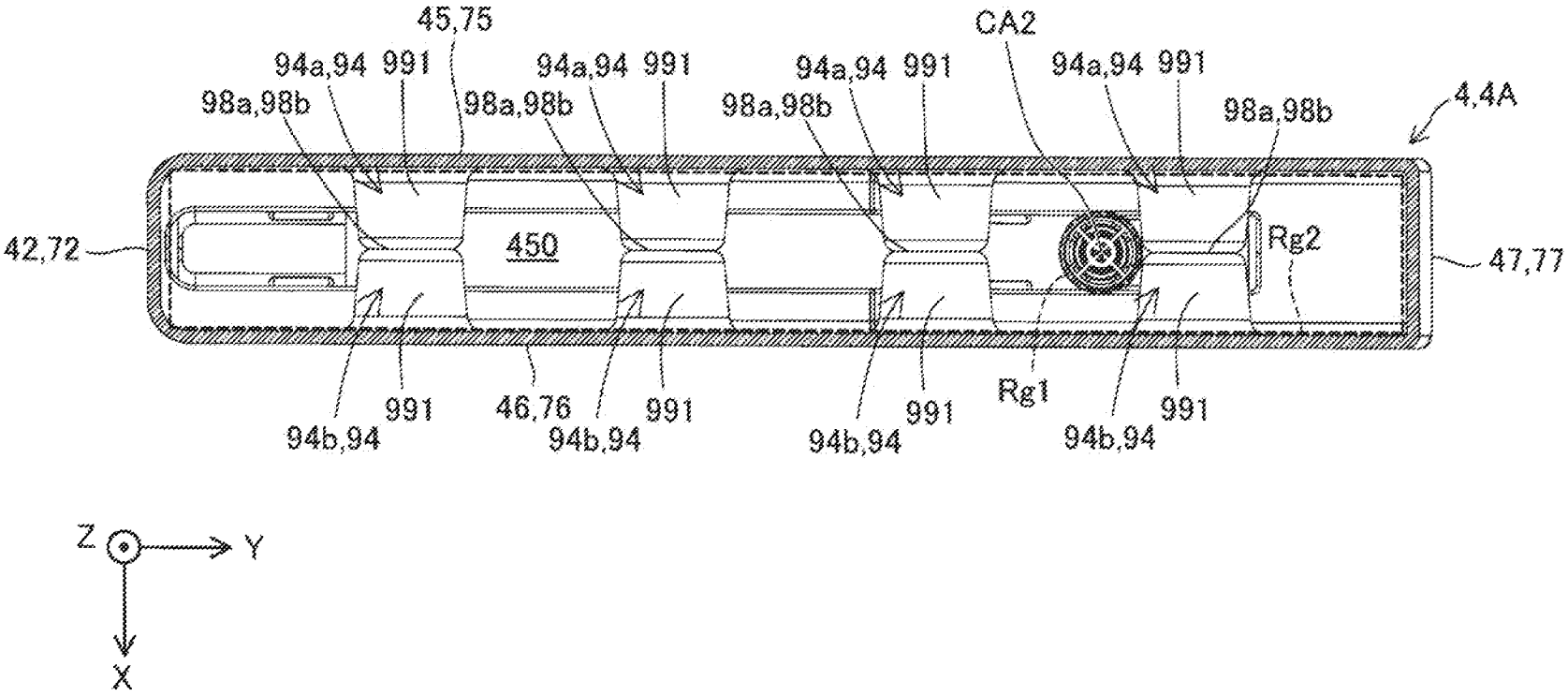
FIG. 14 is a sectional view along line XIV-XIV in FIG. 13.
Figure 15:
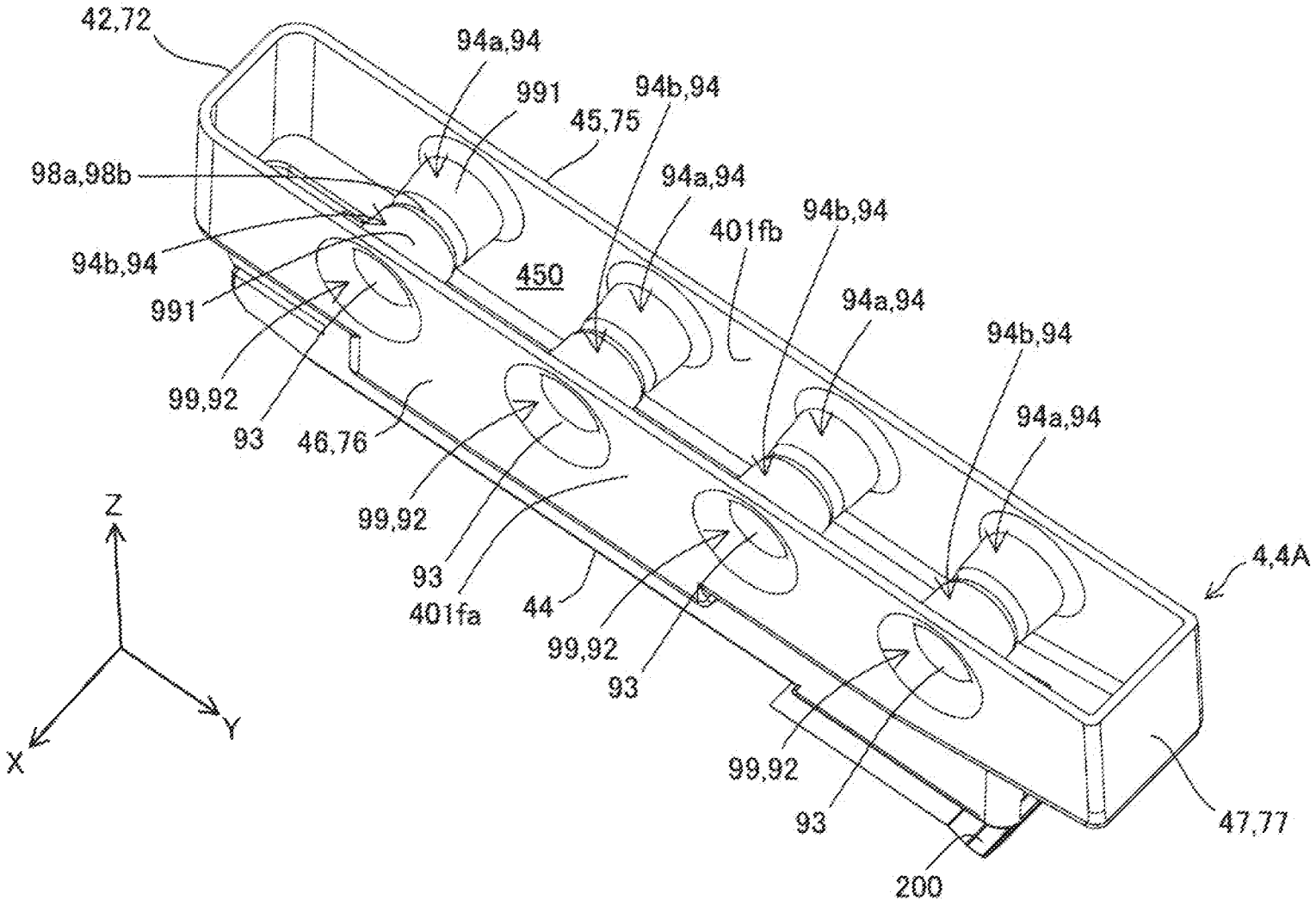
FIG. 15 is a perspective view of the first-type cartridge illustrated in FIG. 14.

FIG. 9 is an exploded perspective view of the first-type cartridge 4A. FIG. 10 is a first perspective view of the first-type cartridge 4A. FIG. 11 is a bottom view of the first-type cartridge 4A. FIG. 12 is a second perspective view of the first-type cartridge 4A. FIG. 13 is a side view of the first-type cartridge 4A. FIG. 14 is a sectional view along line XIV-XIV in FIG. 13. FIG. 15 is a perspective view of the first-type cartridge 4A illustrated in FIG. 14. Of FIGS. 9 to 15, FIGS. 9 and 10 omit illustration of a film 200 that closes an insertion opening 446. The first-type cartridge 4A and the second-type cartridge 4B illustrated in FIG. 1 differ in the capacity of the casing 401. Specifically, the width of the casing 401 of the first-type cartridge 4A, which will be described later, is greater than the width of the casing 401 of the second-type cartridge 4B, and the capacities of the casings 401 thus differ from each other. Since the other configurations including an adaptor 402 and the film 200 are the same in the first-type cartridge 4A and the second-type cartridge 4B, description of details of the configuration of the cartridge 4 will be given below with respect to the first-type cartridge 4A. Note that the first-type cartridge 4A is also simply referred to below as the cartridge 4. In the drawings illustrating the cartridge 4, the X direction, the Y direction, and the Z direction are indicated in accordance with the insertion completed state in which insertion of the cartridge 4 into the cartridge attachment section 6 is completed. That is, in the drawings illustrating the cartridge 4, the X direction, the Y direction, and the Z direction are indicated in accordance with a state before the supply section coupling process, in which the supporting member 610 is rotationally moved.

As illustrated in FIG. 10, the outer shape of the cartridge 4 is an approximately rectangular parallelepiped. In the cartridge 4, a direction extending in the −Y direction corresponding to the inserting direction D1, in which the cartridge 4 is inserted into the cartridge attachment section 6, is a long-side direction, the X direction is a short-side direction corresponding to the width direction, and the Z direction is a height direction. The cartridge 4 has the largest dimension in the long-side direction and has the smallest dimension in the short-side direction.

The cartridge 4 includes a cartridge main body 41 and a circuit substrate 50 attached to the cartridge main body 41 and illustrated in FIG. 11. In the present embodiment, the cartridge main body 41 is constituted by two members as illustrated in FIG. 9. Specifically, the cartridge main body 41 includes the casing 401, the adaptor 402 fit to the casing 401 to be attached thereto, and the liquid supply section 442 attached to the casing 401. Note that, in other embodiments, the cartridge main body 41 may be an integrated component.

Each of the casing 401 and the adaptor 402 is molded by, for example, injection molding of a synthetic resin, such as polypropylene. The casing 401 and the adaptor 402 may be formed of the same material or different materials.

As illustrated in FIG. 12, the cartridge main body 41 includes a front wall 42, a rear wall 47, a top wall 43, a bottom wall 44, a first main body side wall 45, a second main body side wall 46, and a corner section 89 illustrated in FIG. 10. The walls 42, 43, 44, 45, 46, and 47 are also referred to as surfaces 42, 43, 44, 45, 46, and 47, respectively. The front wall 42 and the rear wall 47 face each other in the Y direction extending in the inserting direction D1. The top wall 43 and the bottom wall 44 face each other in the Z direction. As illustrated in FIG. 10, the Z direction is parallel to a central axis CA2 of the liquid supply section 442. The first main body side wall 45 and the second main body side wall 46 face each other in the X direction.

The front wall 42 is positioned on a side in the inserting direction D1, in which the cartridge 4 is inserted into the cartridge attachment section 6. That is, the front wall 42 forms an insertion tip end surface on the −Y direction side, which corresponds to the inserting direction D1 side. The rear wall 47 forms a surface on a side in the +Y direction, which corresponds to the detaching direction D4. The top wall 43 is positioned on the +Z direction side and intersects the front wall 42 and the rear wall 47. The bottom wall 44 is positioned on the −Z direction side, which corresponds to the lower side in the direction of gravity, in the attached state. The bottom wall 44 intersects the front wall 42 and the rear wall 47. The insertion opening 446 into which the liquid introducing section 642 is inserted is formed in the bottom wall 44. The insertion opening 446 and the liquid supply section 442 are positioned so as to overlap each other when the cartridge 4 is viewed from the bottom wall 44 side. In the present embodiment, the liquid supply section 442 is arranged such that the central axis CA2 of the liquid supply section 442 passes through the insertion opening 446.

The first main body side wall 45 is positioned on the −X direction side, and the second main body side wall 46 is positioned on the +X direction side. Each of the first main body side wall 45 and the second main body side wall 46 intersects the front wall 42, the rear wall 47, the top wall 43, and the bottom wall 44 and extends in the inserting direction D1. The corner section 89 is provided in a corner portion in which the front wall 42 and the bottom wall 44 intersect each other. The corner section 89 includes a terminal arrangement section 90 having a shape recessed inwardly. As illustrated in FIG. 11, the circuit substrate 50 is attached to the terminal arrangement section 90.

As illustrated in FIG. 9, the liquid supply section 442 is a cylindrical member protruding from a casing bottom wall 74 of the casing 401, which faces the top wall 43. The liquid supply section 442 has the central axis CA2. The liquid supply section 442 communicates with the liquid chamber 450 in which the liquid is stored and supplies the liquid in the liquid chamber 450 to the printing apparatus 10. Specifically, the liquid supply section 442 is coupled to the liquid introducing section 642 in the attached state and supplies the liquid in the liquid chamber 450 to the ejecting head 22 of the printing apparatus 10 via the liquid introducing section 642. The liquid supply section 442 includes a supply section tip end 442*a* corresponding to a tip end that forms an opening through which the liquid is fed out. A valve mechanism that opens/closes a channel through which the liquid flows is arranged in the liquid supply section 422. The valve mechanism opens when the liquid introducing section 642 is inserted into the liquid supply section 422.

As illustrated in FIG. 9, the adaptor 402 includes an adaptor front wall 82, an adaptor rear wall 87, an adaptor bottom wall 84, a first adaptor side wall 85, and a second adaptor side wall 86. The adaptor front wall 82 constitutes a portion of the front wall 42 and is positioned on the tip end side of the inserting direction D1 side. The adaptor rear wall 87 constitutes a portion of the rear wall 47 and faces the adaptor front wall 82 in the Y direction. The adaptor bottom wall 84 constitutes the bottom wall 44 and intersects the adaptor front wall 82 and the adaptor rear wall 87.

The first adaptor side wall 85 intersects the adaptor bottom wall 84 and extends in the Y direction, which corresponds to the long-side direction of the adaptor 402. The first adaptor side wall 85 is a plate-shaped wall standing from the adaptor bottom wall 84 toward the casing 401. The second adaptor side wall 86 faces the first adaptor side wall 85 in the X direction, which corresponds to the short-side direction of the adaptor 402. The second adaptor side wall 86 intersects the adaptor bottom wall 84 and extends in the Y direction, which corresponds to the long-side direction of the adaptor 402. The second adaptor side wall 86 is a plate-shaped wall standing from the adaptor bottom wall 84 toward the casing 401.

The adaptor 402 has a recessed shape in which the adaptor bottom wall 84 serves as the bottom. The adaptor 402 has an opening on a side facing the adaptor bottom wall 84, and the liquid supply section 442 is arranged inside the adaptor 402 via the opening. A portion of the adaptor 402 in which the liquid supply section 442 is arranged is referred to as a supply section arrangement section 831. The adaptor bottom wall 84 includes the insertion opening 446, through which the liquid introducing section 642 is inserted, at a position facing the supply section tip end 442*a*.

As illustrated in FIG. 10, the adaptor 402 further includes an attachment element 700 that cooperates with the cartridge attachment section 6 in at least one of the attaching process in which the cartridge 4 is attached to the cartridge attachment section 6 of the printing apparatus 10 and the attached state in which the cartridge 4 is attached to the cartridge attachment section 6. The attachment element 700 mechanically cooperates with the cartridge attachment section 6 when, for example, coming into contact with or engaging the cartridge attachment section 6 or inserted into the cartridge attachment section 6. The attachment element 700 includes a cartridge-side identifying member 430, a cartridge guided section 447, the supply section positioning section 448, the cartridge engagement section 497, and the circuit substrate 50 illustrated in FIG. 11.

The cartridge-side identifying member 430 illustrated in FIG. 10 is constituted by a rib. The pattern shape of the cartridge-side identifying member 430 is determined in accordance with the number of ribs and positions of the ribs. The pattern shape differs in accordance with the type of the cartridge 4, that is, the color of the stored liquid. When the correct type of the cartridge 4 is inserted into the corresponding one of the slots 61C, 61M, 61Y and 61K in the attaching process of the cartridge 4, the cartridge-side identifying member 430 is able to pass through the apparatus-side identifying member 630 without coming into collision with the apparatus-side identifying member 630.

As illustrated in FIGS. 10 and 11, the cartridge guided section 447 extends in the inserting direction D1. For ease of understanding, the cartridge guided section 447 is indicated by single hatching in FIGS. 10 and 11. The cartridge guided section 447 extends in the inserting direction D1 from a portion in which the corner section 89 is positioned to a portion in which the insertion opening 446 is positioned. In the width direction of the cartridge 4, a first cartridge guided section 447*a* is positioned on one side with respect to the insertion opening 446, and a second cartridge guided section 447*b* is positioned on the other side with respect to the insertion opening 446. The cartridge guided section 447 is guided in the inserting direction D1 by the apparatus guiding section 602 of the cartridge attachment section 6.

The cartridge guided section 447 is formed of a step in each of the first adaptor side wall 85 and the second adaptor side wall 86. The cartridge guided section 447 is a surface facing the −Z direction. The cartridge guided section 447 formed in the first adaptor side wall 85 is also referred to as the first cartridge guided section 447*a*, and the cartridge guided section 447 formed in the second adaptor side wall 86 is also referred to as the second cartridge guided section 447*b*. When the cartridge 4 is inserted into the cartridge attachment section 6, the surface of the apparatus guiding section 602 on the +Z direction side and the cartridge guided section 447 come into contact with each other, and movement of the cartridge 4 is thus guided in the inserting direction D1 while the posture of the cartridge 4 is maintained.

The supply section positioning section 448 illustrated in FIG. 10 receives the apparatus-side supply section positioning section 644 in the attaching process to thereby position the liquid supply section 442 with respect to the liquid introducing section 642. Specifically, in the supply section coupling process of the attaching process, the supply section positioning section 448 receives the apparatus-side supply section positioning section 644 and regulates movement of the supply section positioning section 448 in a direction intersecting the coupling direction D2 to thereby position the liquid supply section 442 with respect to the liquid introducing section 642. The supply section positioning section 448 is formed in the bottom wall 44 and is a recessed portion depressed from the outer surface of the bottom wall 44. The supply section positioning section 448 is positioned in a portion of the bottom wall 44 between the insertion opening 446 and the end to which the adaptor rear wall 87 is coupled. Note that, in other embodiments, the supply section positioning section 448 may be a hole passing through the bottom wall 44.

The cartridge engagement section 497 is provided in the rear wall 47, specifically, the adaptor rear wall 87. The cartridge engagement section 497 is a recessed portion depressed from the outer surface of the adaptor rear wall 87. The cartridge engagement section 497 is formed in a portion of the adaptor rear wall 87 in the vicinity of the end intersecting the adaptor bottom wall 84. When the attachment engagement section 697 enters the cartridge engagement section 497 in the attached state as illustrated in FIG. 6, the cartridge engagement section 497 engages the attachment engagement section 697. The engagement maintains the attached state of the cartridge 4 to the cartridge attachment section 6.

As illustrated in FIG. 11, the circuit substrate 50 is arranged in the terminal arrangement section 90 provided in the adaptor 402. The circuit substrate 50 includes a cartridge-side terminal 521 that comes into contact with an apparatus-side terminal 721 in the attached state.

As illustrated in FIG. 13, the film 200 is attached to the adaptor 402 in a removable manner in a state of covering the insertion opening 446. The film 200 is peeled off from the cartridge 4 by a user before the cartridge 4 is attached to the cartridge attachment section 6. The film 200 is formed of a synthetic resin, such as polyethylene terephthalate or polypropylene.

As illustrated in FIGS. 12 and 15, the casing 401 is a casing that demarcates the liquid chamber 450 used for storing the liquid and that is hollow. As illustrated in FIGS. 10 and 12, the casing 401 includes a casing top wall 73, the casing bottom wall 74, and four casing side walls 72, 75, 76, and 77. The walls 72 to 77 form the contour of the casing 401.

The casing bottom wall 74 illustrated in FIG. 10 is a wall to which the liquid supply section 442 is coupled. The casing bottom wall 74 forms the bottom surface of the casing 401 in the attachment completed state in which the cartridge 4 is attached to the cartridge attachment section 6. The casing top wall 73 illustrated in FIG. 12 constitutes the top wall 43 of the cartridge main body 41. The casing top wall 73 faces the casing bottom wall 74 in a central axis direction extending along the central axis CA2. As illustrated in FIGS. 10 and 12, the four casing side walls 72, 75, 76, and 77 are walls that couple the casing bottom wall 74 and the casing top wall 73.

The four casing side walls 72, 75, 76, and 77 are the casing front wall 72, the first casing side wall 75, the second casing side wall 76, and the casing rear wall 77. The casing front wall 72 constitutes a portion of the front wall 42 and is positioned on the tip end side in the inserting direction D1. The casing rear wall 77 constitutes a portion of the rear wall 47 of the cartridge main body 41. The casing rear wall 77 faces the casing front wall 72 in the Y direction extending in the inserting direction D1.

As illustrated in FIG. 10, the first casing side wall 75, which corresponds to a first side wall, constitutes a portion of the first main body side wall 45. The first casing side wall 75 couples the casing front wall 72 and the casing rear wall 77. The first casing side wall 75 is a side wall on one side in the width direction of the casing 401. As illustrated in FIG. 12, the second casing side wall 76, which corresponds to a second side wall, constitutes a portion of the second main body side wall 46. The second casing side wall 76 faces the first casing side wall 75 in the X direction, which corresponds to the width direction of the casing 401. That is, the second casing side wall 76 is a side wall on the other side in the width direction of the casing 401. The second casing side wall 76 couples the casing front wall 72 and the casing rear wall 77. The external sizes of the first casing side wall 75 and the second casing side wall 76 are larger than the external sizes of the casing front wall 72 and the casing rear wall 77. In the present embodiment, the external sizes of the first casing side wall 75 and the second casing side wall 76 are the same and the largest of the walls 72, 73, 74, 75, 76, and 77 that form the casing 401.

As illustrated in FIGS. 10 and 12, the casing 401 includes a concave/convex portion 99. The concave/convex portion 99 includes a first concave/convex portion 91 formed in the first casing side wall 75, which corresponds to the first side wall, as illustrated in FIG. 10 and a second concave/convex portion 92 formed in the second casing side wall 76, which corresponds to the second side wall, as illustrated in FIG. 12.

As illustrated in FIG. 10, four first concave/convex portions 91 are provided. The four first concave/convex portions 91 are formed at predetermined intervals so as to be arranged side by side in the Y direction extending in the inserting direction D1. As illustrated in FIG. 12, four second concave/convex portions 92 are provided. The four second concave/convex portions 92 are formed at predetermined intervals so as to be arranged side by side in the Y direction extending in the inserting direction D1. The four first concave/convex portions 91 and the four second concave/convex portions 92 are formed such that each of the first concave/convex portions 91 faces a corresponding one of the second concave/convex portions 92 in the X direction, which corresponds to the width direction of the casing 401.

As illustrated in FIG. 15, the concave/convex portion 99 includes a concave portion 93 recessed from an outer surface 401*fa* of the casing 401 toward the inner side which corresponds to the liquid chamber 450 side and a convex portion 94 formed of the concave portion 93 and protruding from an inner surface 401*fb* of the casing 401 toward the liquid chamber 450 side. Here, the concave portion 93 of the first concave/convex portion 91 illustrated in FIG. 10 is also referred to as a first concave portion 93*a*, and the convex portion 94 of the first concave/convex portion 91 illustrated in FIG. 14 is also referred to as a first convex portion 94*a*. Moreover, the concave portion 93 of the second concave/convex portion 92 illustrated in FIG. 12 is also referred to as a second concave portion 93*b*, and the convex portion 94 of the second concave/convex portion 92 illustrated in FIG. 14 is also referred to as a second convex portion 94*b*.

As illustrated in FIGS. 10 and 12, a sectional shape of the concave portion 93, which is orthogonal to the X direction in which the concave portion 93 is recessed, is round. Moreover, as illustrated in FIG. 15, a sectional shape of the convex portion 94, which is orthogonal to the X direction in which the convex portion 94 protrudes, is round. Accordingly, in the attachment completed state in which the cartridge 4 is attached to the cartridge attachment section 6, an outer peripheral surface 991 of the convex portion 94 has no horizontal surface. That is, as illustrated in FIG. 6, in the attachment completed state, an upper surface 998 of the outer peripheral surface 991 of the convex portion 94, which is positioned in an upper portion, is an arc-shaped surface and is inclined with respect to the horizontal direction. That is, the upper surface 998 is inclined with respect to the horizontal direction so as to extend gradually downward from the uppermost apex portion.

As illustrated in FIG. 14, a first tip end 98*a*, which is a tip end of the first convex portion 94*a* in the protruding direction, and a second tip end 98*b*, which is a tip end of the second convex portion 94*b* in the protruding direction, are bonded to each other. Each of the first tip end 98*a* and the second tip end 98*b* is a round planar surface. The convex portion 94 of the concave/convex portion 99 is disposed at a position deviated from the central axis CA2 of the liquid supply section 442 as illustrated in FIG. 14. In the present embodiment, when the cartridge 4 is viewed in a direction extending along the central axis CA2 of the liquid supply section 442, for example, from the side on which the casing top wall 73 is positioned, the convex portion 94 of the concave/convex portion 99 is disposed in a second region Rg2 different from a first region Rg1, in which the liquid supply section 442 is positioned.

The concave/convex portion 99 is formed by, for example, the following method. First, the first casing side wall 75 and the second casing side wall 76 are heated and softened to be in a starch-syrup-like state, and a column-shaped pin is then pressed against the outer surface 401*fa* of each of the first casing side wall 75 and the second casing side wall 76 in an inward direction. After the pin is pressed until the tip ends of the first convex portion 94*a* and the second convex portion 94*b*, which are formed by being pressed by the pin, come into contact with each other, the casing 401 is cooled, for example, naturally. The first concave/convex portion 91 and the second concave/convex portion 92 are thus formed.

According to the aforementioned embodiment, since the casing 401 that is hollow includes the concave/convex portion 99 as illustrated in FIGS. 10 and 12, it is possible to improve rigidity of the casing 401 without adding a component separate from the casing 401. This makes it possible to reduce possible damage of the casing 401 even in an instance in which an impact is applied to the cartridge 4 when, for example, the cartridge 4 falls down. Moreover, even when the internal pressure of the liquid chamber 450 is lowered, it is possible to reduce possible deformation of the casing 401. Since the rigidity of the casing 401 is improved by using the concave/convex portion 99, it is possible to ensure desired rigidity regardless of the amount of liquid stored in the liquid chamber 450, thus making it possible to flexibly change the amount of liquid to be stored in the liquid chamber 450. Further, according to the aforementioned embodiment, the first tip end 98*a* of the first convex portion 94*a* and the second tip end 98*b* of the second convex portion 94*b* are bonded to each other as illustrated in FIG. 14, thus making it possible to further improve the rigidity of the casing 401. Further, according to the aforementioned embodiment, by providing the concave/convex portion 99 in the first casing side wall 75 and the second casing side wall 76, each of which has a large external size, as illustrated in FIGS. 10 and 12, it is possible to improve rigidity of the first casing side wall 75 and the second casing side wall 76 that are walls each of which has the large external size and thus tends to have low rigidity.

According to the aforementioned embodiment, the concave/convex portion 99 includes the concave portion 93 recessed from the outer surface 401*fa* of the casing 401 toward the inner side which corresponds to the liquid chamber 450 side and the convex portion 94 formed of the concave portion 93 and protruding from the inner surface 401*fb* of the casing 401 toward the liquid chamber 450 side as illustrated in FIG. 15. It is thereby possible to easily form the concave portion 93 and the convex portion 94 of the concave/convex portion 99.

According to the aforementioned embodiment, when the cartridge 4 is viewed in the direction extending along the central axis CA2, the concave/convex portion 99 is disposed in the second region Rg2 different from the first region Rg1, in which the liquid supply section 442 is positioned, as illustrated in FIG. 14. When the liquid is poured into the liquid chamber 450, after, for example, the cartridge 4 is arranged to have a pouring posture in which the supply section tip end 442*a* of the liquid supply section 442, which is illustrated in FIG. 10, faces upward, a stick-shaped liquid pouring tube which is a jig is inserted into the liquid chamber 450 from the liquid supply section 442. The liquid pouring tube is inserted into the liquid chamber 450 such that the tip end of the liquid pouring tube is positioned in the vicinity of the top wall 43 to suppress generation of bubbles in the liquid chamber 450 in a liquid pouring process, and the liquid is then poured. The liquid is poured while the tip end of the liquid pouring tube is moved to the bottom wall 44 side, that is, the upper side of the cartridge 4 having the pouring posture, in accordance with the rising liquid surface in the liquid chamber 450. In this instance, since no concave/convex portion 99 is disposed in the first region Rg1, it is possible to reduce the possibility that the liquid pouring tube which is the jig comes into collision with the convex portion 94 when the liquid is poured into the liquid chamber 450 from the liquid supply section 442. It is thus possible to smoothly pour the liquid into the liquid chamber 450 from the liquid supply section 442.

According to the aforementioned embodiment, in the attachment completed state, the upper surface 998 of the outer peripheral surface 991 of the convex portion 94 is an arc-shaped surface and is inclined with respect to the horizontal direction as illustrated in FIG. 6. Accordingly, the upper surface 998 of the convex portion 94 has no horizontal surface in the attachment completed state, thus making it possible to suppress the liquid in the liquid chamber 450 remaining on the upper surface 998 of the convex portion 94. It is thereby possible to reduce an amount of liquid to remain in the liquid chamber 450. Moreover, according to the aforementioned embodiment, the convex portion 94 has a truncated cone shape, and a sectional shape of the convex portion 94, which is orthogonal to the protruding direction of the convex portion 94, is round, as illustrated in FIG. 15. It is therefore possible to easily form the convex portion 94 such that, in the attachment completed state, the upper surface 998 of the outer peripheral surface 991 of the convex portion 94 has an arc-shaped surface.

B. Other Embodiments

B-1. Another Embodiment 1

The concave/convex portion 99 is formed in the first casing side wall 75 and the second casing side wall 76 in the aforementioned embodiment but may be formed in a different wall of the casing 401. For example, the concave/convex portion 99 may be formed in the casing front wall 72 and the casing rear wall 77. When the concave/convex portion 99 is formed in the casing front wall 72 and the casing rear wall 77, the casing front wall 72 functions as the first side wall, and the casing rear wall 77 functions as the second side wall. For example, the concave/convex portion 99 may be formed in the casing top wall 73 and the casing bottom wall 74. Moreover, the concave/convex portion 99 is not necessarily formed in two walls of the casing 401 which face each other. For example, the concave/convex portion 99 may be formed in at least one of the casing top wall 73, the first casing side wall 75, the second casing side wall 76, the casing front wall 72, the casing rear wall 77, and the casing bottom wall 74. In addition, the concave portion 93 and the convex portion 94 of the concave/convex portion 99 may be formed at different positions. Further, the shape of the convex portion 94 is not limited to the truncated cone shape. The convex portion 94 may have, for example, a rectangular parallelepiped shape or a column shape.

The disclosure is not limited to an ink jet printer and a cartridge used in an ink jet printer and may be applied to a cartridge attached to any printing apparatus that ejects liquid other than ink. For example, the disclosure may be applied to various printing apparatuses as follows and cartridges therefor:

(1) an image recording apparatus such as a facsimile machine;
(2) a printing apparatus that ejects a coloring material used in manufacturing a color filter for an image display apparatus such as a liquid crystal display;
(3) a printing apparatus that ejects an electrode material used to form electrodes of an organic electroluminescence (EL) display, a surface emitting display (field emission display (FED)), and the like;
(4) a printing apparatus that ejects liquid containing a bioorganic substance used in manufacturing biochips;
(5) a sample printing apparatus serving as a precision pipette;
(6) a printing apparatus of lubricating oil;
(7) a printing apparatus of a liquid resin;
(8) a printing apparatus that ejects lubricating oil in a pinpoint manner onto a precision instrument such as a clock or a camera;
(9) a printing apparatus that ejects a transparent liquid resin such as an ultraviolet curing liquid resin on a substrate to form a hemispherical microlens (an optical lens) used in an optical communication element or the like;

(10) a printing apparatus that ejects an acid or alkaline etchant to perform etching of a substrate or the like; and

(11) a printing apparatus including a liquid ejecting head that ejects any other minute liquid droplets.

Note that the term "liquid droplets" refers to a state of liquid ejected from the printing apparatus, and examples thereof include a granular shape, a tear shape, and a thread shape in a trailing shape. Further, the term "liquid" here refers to any material that is able to be ejected by the printing apparatus. For example, "liquid" may be any material as long as it is a material in a state in which a substance is in a liquid phase, and examples thereof include a liquid state material having high or low viscosity and a liquid state material such as sol, gel water, other inorganic solvents, organic solvent, solution, liquid resin, and liquid metal. Examples of the "liquid" further include, in addition to liquid as one state of a substance, materials in which particles of a functional material having solids such as pigments and metal particles are dissolved, dispersed, or mixed in a solvent. In addition, representative examples of liquid include ink as described in the embodiment described above, liquid crystal, and the like. Examples of the ink include various liquid compositions such as typical water-based ink, oil-based ink, gel ink, and hot-melt ink.

C. Other Aspects

The disclosure is not limited to the embodiments described above and may be implemented in various configurations within a range not departing from the gist of the disclosure. To address some or all of the above-described problems or to achieve some or all of the above-described effects, technical features in the embodiments corresponding to technical features in the aspects described below can be replaced or combined as appropriate. The technical features can be deleted as appropriate unless the technical features are described as essential in the present specification.

(1) According to an aspect of the disclosure, a cartridge that is detachably attached to a cartridge attachment section of a printing apparatus is provided. The cartridge includes a casing that demarcates a liquid chamber used for storing a liquid and that is hollow, and a liquid supply section that communicates with the liquid chamber and supplies the liquid in the liquid chamber to the printing apparatus. The casing includes a concave/convex portion. According to this aspect, by providing the concave/convex portion, it is possible to improve rigidity of the casing without adding a component separate from the casing.

(2) In the above-described aspect, the concave/convex portion may include a concave portion recessed from an outer surface of the casing toward a side of the liquid chamber and a convex portion formed of the concave portion and protruding from an inner surface of the casing. According to this aspect, it is possible to easily form the concave portion and the convex portion of the concave/convex portion.

(3) In the above-described aspect, the liquid supply section may include a central axis, and when the cartridge is viewed in a direction extending along the central axis, the concave/convex portion may be disposed in a second region different from a first region, in which the liquid supply section is positioned. According to this aspect, it is possible to reduce the possibility that a jig used for pouring the liquid comes into collision with the convex portion when the liquid is poured into the liquid chamber from the liquid supply section. It is thus possible to smoothly pour the liquid into the liquid chamber from the liquid supply section.

(4) In the above-described aspect, an upper surface of the convex portion may be inclined with respect to a horizontal direction in an attachment completed state in which the cartridge is attached to the cartridge attachment section. According to this aspect, it is possible to suppress the liquid in the liquid chamber remaining on the upper surface of the convex portion. It is thereby possible to reduce an amount of liquid to remain in the liquid chamber.

(5) In the above-described aspect, the casing may include a casing bottom wall to which the liquid supply section is coupled, a casing top wall that faces the casing bottom wall, and a casing side wall that couples the casing bottom wall and the casing top wall, and the concave/convex portion may be formed in the casing side wall. According to this aspect, the concave/convex portion formed in the casing side wall is able to improve the rigidity of the casing.

(6) In the above-described aspect, the casing side wall may include a first side wall and a second side wall that face each other, the concave/convex portion may include a first concave/convex portion formed in the first side wall and a second concave/convex portion formed in the second side wall, and a first tip end of a first convex portion corresponding to the convex portion provided in the first concave/convex portion and a second tip end of a second convex portion corresponding to the convex portion provided in the second concave/convex portion may be bonded to each other. According to this aspect, it is possible to further improve the rigidity of the casing by causing the first tip end and the second tip end to be bonded to each other.

(7) In the above-described aspect, the casing side wall may include a casing front wall positioned on a tip end side in an inserting direction in which the cartridge is inserted into the cartridge attachment section, a casing rear wall facing the casing front wall, a first casing side wall corresponding to the first side wall that couples the casing front wall and the casing rear wall, and a second casing side wall facing the first casing side wall and corresponding to the second side wall that couples the casing front wall and the casing rear wall, and an external size of each of the first casing side wall and the second casing side wall may be larger than an external size of the casing front wall and an external size of the casing rear wall. According to this aspect, by providing the concave/convex portion in the first casing side wall and the second casing side wall, each of which has a large external size, it is possible to improve rigidity of the first casing side wall and the second casing side wall that are walls each of which has the large external size and thus tends to have low rigidity.

(8) In the above-described aspect, a sectional shape of the convex portion may be round, the sectional shape being orthogonal to a protruding direction of the convex portion. According to this aspect, it is possible to provide a concave/convex portion provided with a convex portion having a round sectional shape.

The disclosure is able to be implemented in an aspect of a manufacturing method of a cartridge, a printing system including a cartridge and a printing apparatus, and the like in addition to the above-described aspects.

What is claimed is:

1. A cartridge configured to be attached to and detached from a cartridge attachment section of a printing apparatus, the cartridge comprising:

a casing that demarcates a liquid chamber used for storing a liquid and that forms a hollow space; and a liquid supply section that communicates with the liquid chamber and supplies the liquid in the liquid chamber to the printing apparatus, wherein the casing includes a concave/convex portion, and a part of the concave/convex portion protrudes from an inner surface of the liquid chamber inside the hollow space.

2. The cartridge according to claim 1, wherein the concave/convex portion includes a concave portion recessed from an outer surface of the casing toward the liquid chamber and a convex portion formed of the concave portion and protruding from an inner surface of the casing.

3. The cartridge according to claim 2, wherein the liquid supply section has a central axis, and when the cartridge is viewed in a direction along the central axis, the concave/convex portion is disposed in a second region different from a first region in which the liquid supply section is positioned.

4. The cartridge according to claim 2, wherein an upper surface of the convex portion is inclined with respect to a horizontal direction in an attachment completed state in which the cartridge is attached to the cartridge attachment section.

5. The cartridge according to claim 2, wherein the casing includes a casing bottom wall to which the liquid supply section is coupled, a casing top wall that faces the casing bottom wall, and a casing side wall that couples the casing bottom wall and the casing top wall, and the concave/convex portion is formed in the casing side wall.

6. The cartridge according to claim 5, wherein the casing side wall includes a first side wall and a second side wall that face each other, the concave/convex portion includes a first concave/convex portion formed in the first side wall and a second concave/convex portion formed in the second side wall, and a first tip end of a first convex portion corresponding to the convex portion included in the first concave/convex portion and a second tip end of a second convex portion corresponding to the convex portion included in the second concave/convex portion are bonded to each other.

7. The cartridge according to claim 6, wherein the casing side wall includes a casing front wall positioned on a tip end side in an inserting direction in which the cartridge is inserted into the cartridge attachment section, a casing rear wall facing the casing front wall, a first casing side wall corresponding to the first side wall that couples the casing front wall and the casing rear wall, and a second casing side wall facing the first casing side wall and corresponding to the second side wall that couples the casing front wall and the casing rear wall, and an external size of each of the first casing side wall and the second casing side wall is larger than an external size of the casing front wall and an external size of the casing rear wall.

8. The cartridge according to claim 2, wherein a sectional shape of the convex portion is round, the sectional shape being orthogonal to a direction in which the convex portion protrudes.

* * * * *